US010639688B2

(12) United States Patent
Furumoto et al.

(10) Patent No.: US 10,639,688 B2
(45) Date of Patent: May 5, 2020

(54) STRIP PROFILE CONTROL METHOD OF HOT FINISHING TANDEM ROLLING MILL AND HOT FINISHING TANDEM ROLLING MILL

(71) Applicant: Primetals Technologies Japan, Ltd., Tokyo (JP)

(72) Inventors: Hideaki Furumoto, Hiroshima (JP); Jiro Hasai, Hiroshima (JP); Hironori Abe, Hiroshima (JP); Masatomo Yamane, Hiroshima (JP); Kanji Hayashi, Hiroshima (JP); Shinya Kanemori, Hiroshima (JP)

(73) Assignee: PRIMETALS TECHNOLOGIES JAPAN, LTD., Tokyo (JP)

( * ) Notice: Subject to any disclaimer, the term of this patent is extended or adjusted under 35 U.S.C. 154(b) by 365 days.

(21) Appl. No.: 15/435,881

(22) Filed: Feb. 17, 2017

(65) Prior Publication Data

US 2017/0348745 A1 Dec. 7, 2017

(30) Foreign Application Priority Data

Jun. 2, 2016 (JP) ..... 2016-110705

(51) Int. Cl.
*B21B 37/28* (2006.01)
*B21B 37/16* (2006.01)
(Continued)

(52) U.S. Cl.
CPC ..... *B21B 37/165* (2013.01); *B21B 1/26* (2013.01); *B21B 37/28* (2013.01); *B21B 45/004* (2013.01);
(Continued)

(58) Field of Classification Search
CPC ..... B21B 2269/00–04; B21B 2269/10; B21B 37/16; B21B 37/165; B21B 37/20;
(Continued)

(56) References Cited

U.S. PATENT DOCUMENTS 3,934,438 A * 1/1976 Arimura ..... B21B 37/38 72/9.3
4,274,273 A * 6/1981 Fapiano ..... B21B 37/74 700/153
(Continued)

FOREIGN PATENT DOCUMENTS

EP 0 618 020 A1 10/1994
JP 56160806 A * 12/1981 ..... B21B 1/466
(Continued)

OTHER PUBLICATIONS

Yahiro, JP-09141312-A Translation, (Year: 1997).*
(Continued)

*Primary Examiner* — Adam J Eiseman
*Assistant Examiner* — Bobby Yeonjin Kim
(74) *Attorney, Agent, or Firm* — Mattingly & Malur, PC

(57) ABSTRACT

In a decision control device of a control system, a predetermined pass schedule is decided by adjusting the rolling force per unit width at a last stand of a hot finishing tandem rolling mill to cause the edge profile on the outlet side of the last stand to fall within an allowable range based on the relationship between a strip crown and the edge profile on the outlet side of the last stand with respect to the rolling force per unit width and a strip shape control parameter, obtained regarding the last stand, and adjusting the strip shape control parameter of the last stand to cause the strip shape on the outlet side of the last stand to fall within an allowable range and cause the strip crown to become a predetermined value or smaller.

9 Claims, 25 Drawing Sheets

(51) Int. Cl.

| | |
|---|---|
| ***B21B 1/26*** | (2006.01) |
| ***B21B 45/00*** | (2006.01) |
| *B21B 37/38* | (2006.01) |
| *B21B 37/40* | (2006.01) |
| *B21B 37/58* | (2006.01) |
| *B21B 28/04* | (2006.01) |

(52) U.S. Cl.
CPC ..... *B21B 28/04* (2013.01); *B21B 37/38* (2013.01); *B21B 37/40* (2013.01); *B21B 37/58* (2013.01); *B21B 2265/12* (2013.01); *B21B 2269/04* (2013.01); *B21B 2269/14* (2013.01)

(58) Field of Classification Search
CPC ..... B21B 37/28; B21B 37/38; B21B 37/58; B21B 37/30; B21B 37/42; B21B 37/62; B21B 1/26; B21B 1/28; B21B 28/04; B21B 28/00; B21B 28/02; B21B 45/004
See application file for complete search history.

(56) References Cited

U.S. PATENT DOCUMENTS

| | | | | |
|---|---|---|---|---|
| 5,651,281 | A | 7/1997 | Seidel | |
| 2003/0168137 | A1* | 9/2003 | Chikushi | B21B 1/26 148/648 |
| 2005/0125091 | A1* | 6/2005 | Reinschke | B21B 37/28 700/148 |

FOREIGN PATENT DOCUMENTS

| | | | | | |
|---|---|---|---|---|---|
| JP | 61-18405 | A | | 5/1986 | |
| JP | 61-129211 | A | | 6/1986 | |
| JP | 05-237527 | A | | 9/1993 | |
| JP | 6-304623 | A | | 11/1994 | |
| JP | 9-141312 | A | | 6/1997 | |
| JP | 09141312 | A | * | 6/1997 | B21B 37/38 |
| JP | 2002-11509 | A | | 1/2002 | |
| JP | 2005-313177 | A | | 11/2005 | |
| JP | 2006-239727 | A | | 9/2006 | |

OTHER PUBLICATIONS

Kichi, JP-56160806-A Translation (Year: 1981).*
Partial Extended European Search Report received in corresponding European Application No. 17 15 7315 dated Sep. 11, 2017.
Chinese Office Action received in corresponding Chinese Application No. 201710044067.9 dated Aug. 29, 2018.
Korean Office Action received in corresponding Korean Application No. 10-2017-0009673 dated May 17, 2018.
Indian Office Action received in corresponding Indian Application No. 201714005937 dated Aug. 16, 2019.

* cited by examiner

STRIP PROFILE CONTROL METHOD OF HOT FINISHING TANDEM ROLLING MILL AND HOT FINISHING TANDEM ROLLING MILL

BACKGROUND OF THE INVENTION

1. Field of the Invention

The present invention relates to a strip profile control method of a hot finishing tandem rolling mill and a hot finishing tandem rolling mill.

2. Description of the Related Art

As a measure to reduce the edge drop, which is a sudden strip thickness decrease in the vicinity of the strip end portion in width direction in a hot finishing tandem rolling mill, there is a method for reducing the edge drop while satisfying a target strip crown as disclosed in JP-1993-237527-A (Patent Document 1). Specifically, in the method, operation in which the rolling direction tension at the latter stage of a finishing rolling mill is toward the pull side or in the direction of center waves is carried out and the rolling force becomes small in the vicinity of the strip end portion in width direction in the rolling material, so that the edge drop attributed to roll flattening is made small.

Furthermore, in JP-1986-108405-A (Patent Document 2), a technique is described in which a rolling mill having a roll shift mechanism is placed at the last stand of a hot finishing tandem rolling mill as equipment to suppress the edge-up generated due to a roll thermal crown and wear.

SUMMARY OF THE INVENTION

Normally, in a hot finishing rolling mill, work rolls wear due to increase in the number of rolled coils. In particular, due to local wear at the strip end portion in width direction and a thermal crown generated due to thermal expansion of a work roll part, an edge-up phenomenon in which the strip thickness becomes large at the strip end portion in width direction occurs.

In the technique described in the above-described Patent Document 1, a strip crown can be set to a predetermined value. Furthermore, in association with this, the edge drop attributed to roll flattening can be made small. However, the technique described in Patent Document 1 involves a problem that it is impossible to set both of the strip crown and the edge drop to the predetermined value or smaller. This is the same also in the case of the edge-up. In particular, the edge-up does not only preclude achievement of a desired strip profile but can be a cause of the deterioration of the strip passing performance. Therefore, the edge-up needs to be suppressed as much as possible.

Moreover, a strip profile preset control model in the hot rolling of the above-described Patent Document 1 is a model with which only the strip crown defined at a predetermined position is controlled to the predetermined value or smaller. With this model, there is a problem that it is very difficult to control both of the strip crown and the edge profile to the predetermined value or smaller.

So, the present invention intends to solve the problems in the above related arts and provide a strip profile control method of a hot finishing tandem rolling mill and a hot finishing tandem rolling mill that can control the edge profile to a predetermined value or smaller and control a strip crown to a predetermined value or smaller while keeping the strip shape within an allowable range.

To achieve the above-described object, a first aspect of the present invention provides a strip profile control method of a hot finishing tandem rolling mill having a plurality of stands. The strip profile control method includes adjusting rolling force per unit width at a last stand of the hot finishing tandem rolling mill to cause an edge-up or edge drop on an outlet side of the last stand to fall within an allowable range based on a relationship between a strip crown and the edge-up or edge drop on the outlet side of the last stand with respect to the rolling force per unit width and a flatness control parameter, obtained regarding the last stand. The strip profile control method further includes adjusting the flatness control parameter of the last stand to cause flatness on the outlet side of the last stand to fall within an allowable range and cause the strip crown to become a predetermined value or smaller, and adjusting a pass schedule of the last stand based on the adjusted rolling force per unit width and the adjusted flatness control parameter of the last stand.

Furthermore, according to a second aspect of the present invention, in the first aspect, the strip profile control method further includes adjusting the flatness control parameter of upstream-side stands to cause the flatness at the last stand to fall within the allowable range and cause the strip crown to become the predetermined value or smaller from the last stand toward the upstream side sequentially if the flatness on the outlet side of the last stand does not fall within the allowable range or the strip crown on the outlet side of the last stand does not become the predetermined value or smaller only by the adjusting the flatness control parameter of the last stand.

Moreover, according to a third aspect of the present invention, in the first aspect, the strip profile control method further includes obtaining the amount of reduction in thickness at the last stand for realizing the rolling force per unit width at the last stand and deciding a reduction schedule to cause the flatness to fall within the allowable range based on the amount of reduction in thickness.

In addition, according to a fourth aspect of the present invention, in the first aspect, the strip profile control method further includes polishing a work roll of the last stand while carrying out rolling at each stand by using the pass schedule.

Furthermore, according to a fifth aspect of the present invention, in the first aspect, the adjusting the rolling force per unit width at the last stand is carried out based on the relationship between the strip crown and the edge-up or edge drop on the outlet side of the last stand regarding an existing pass schedule of the hot finishing tandem rolling mill, and the adjusting the flatness control parameter of the last stand is carried out regarding an intermediate pass schedule obtained by the adjusting the rolling force per unit width of the existing pass schedule.

Moreover, according to a sixth aspect of the present invention, in the first aspect, the flatness control parameter of the last stand is the work roll bending force of a work roll bender, a roll cross angle, or the amount of roll shift.

Furthermore, to achieve the above-described object, a seventh aspect of the present invention provides a hot finishing tandem rolling mill having a plurality of stands. The hot finishing tandem rolling mill includes reduction devices and strip shape control actuators that are each provided at a respective one of the plurality of stands, a decision control device that decides a predetermined pass schedule, and a rolling mill control device that controls the reduction devices and the strip shape control actuators based on the predetermined pass schedule decided in the decision control device. In the hot finishing tandem rolling mill, the decision control device decides the predetermined pass schedule by adjusting rolling force per unit width at a last stand of the hot finishing tandem rolling mill to cause an edge-up or edge drop on an outlet side of the last stand to fall within an allowable range based on a relationship between a strip crown and the edge-up or edge drop on the outlet side of the last stand with respect to the rolling force per unit width and a flatness control parameter, obtained regarding the last stand, and adjusting the flatness control parameter of the last stand to cause flatness on the outlet side of the last stand to fall within an allowable range and cause the strip crown to become a predetermined value or smaller. Furthermore, the rolling mill control device controls the reduction devices to obtain the adjusted rolling force per unit width at the last stand and controls the strip shape control actuators to obtain the adjusted flatness control parameter of the last stand.

Moreover, according to an eighth aspect of the present invention, in the seventh aspect, when deciding the predetermined pass schedule, the decision control device adjusts the flatness control parameter of upstream-side stands to cause the flatness at the last stand to fall within the allowable range and cause the strip crown to become the predetermined value or smaller from the last stand toward the upstream side sequentially if the flatness on the outlet side of the last stand does not fall within the allowable range or the strip crown on the outlet side of the last stand does not become the predetermined value or smaller only by adjustment of the flatness control parameter of the last stand.

In addition, according to a ninth aspect of the present invention, in the seventh aspect, when deciding the predetermined pass schedule, the decision control device obtains the amount of reduction in thickness at the last stand for realizing the rolling force per unit width at the last stand and decides a reduction schedule to cause the flatness to fall within the allowable range based on the amount of reduction in thickness.

Furthermore, according to a tenth aspect of the present invention, in the seventh aspect, the hot finishing tandem rolling mill further includes a roll polishing device. Moreover, the rolling mill control device controls the reduction devices, the strip shape control actuators, and the roll polishing device to carry out rolling at each of the plurality of stands based on the predetermined pass schedule and polish a work roll of the last stand by the roll polishing device.

Effect of the Invention

According to the first and seventh aspects, the edge profile on the last stand outlet side can be controlled to the predetermined value or smaller and the strip crown can also be controlled to the predetermined value or smaller while the strip shape is kept within the allowable range. Thus, a favorable strip profile can be obtained.

Furthermore, according to the second and eighth aspects, not only can the edge profile be controlled to the predetermined value or smaller more surely, but the strip crown can also be controlled to the predetermined value or smaller while the strip shape is kept within the allowable range.

Moreover, according to the third and ninth aspects, the constancy of the strip crown ratio on the outlet side of each stand can be realized. Thus, the strip shape also becomes favorable and it becomes possible to provide a more favorable strip profile.

In addition, according to the fourth and tenth aspects, rolling is carried out while the surface shape of the work roll is improved. Thus, the edge profile on the last stand outlet side can be controlled to the predetermined value more easily. Therefore, the control range of the respective parameters such as the rolling force per unit width at the last stand is widened and the operation becomes easier.

Furthermore, according to the fifth aspect, not only can the edge profile be controlled to the predetermined value or smaller stably and surely, but the strip crown can also be controlled to the predetermined value or smaller while the strip shape is kept within the allowable range.

Moreover, according to the sixth aspect, the work roll bender, the roll cross angle, or the amount of roll shift is changed in rolling, so that a favorable strip profile can be obtained more easily.

DESCRIPTION OF THE PREFERRED EMBODIMENTS

First, the strip profile in the present invention refers to the strip thickness distribution in the strip width direction and is classified into a strip central portion and a strip edge portion. The strip profile is composed of a strip crown defined based on the strip thickness difference between the strip center and the position across which the strip is divided into the strip center and the edge portion, and an edge-up or edge drop defined based on the strip thickness difference between the position across which the strip is divided into the strip center and the edge portion and a position near the strip end in the strip edge portion.

Furthermore, the strip shape means the flatness of a strip and the flatness involves edge waves, center waves, and so forth. Moreover, the flatness involves the steepness obtained by dividing the wave height of the strip by the pitch of the wave of the strip, and so forth. The flatness has a relation to the strip crown, and what is obtained by multiplying change in the strip crown ratio between the outlet side and inlet side of a stand by a shape change coefficient determined by the work roll diameter, the strip width, the strip thickness, and so forth is the flatness. The strip shape to be described hereinafter refers to the flatness.

Next, the background to the making of the present invention will be described below.

Figure 1:
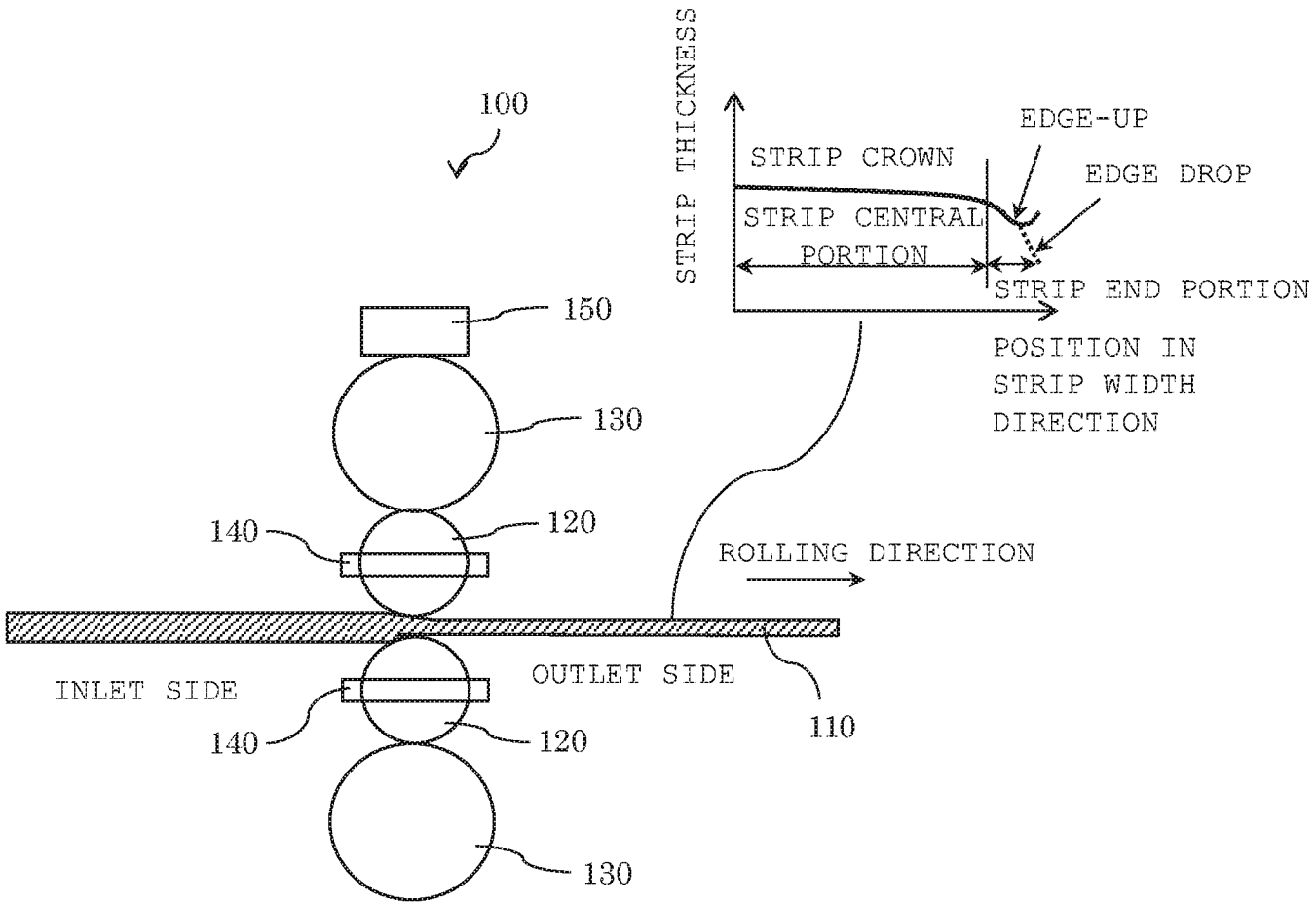
FIG. 1 is a diagram showing a last stand of a hot finishing tandem rolling mill and a strip profile.

In the strip profile of a rolling material, characteristics are different between a strip central portion area and a strip end portion in width direction area as shown in FIG. 1. The strip profile suddenly changes at the strip end portion in width direction.

Here, the strip central portion crown, i.e. the strip crown, is affected by roll deflection in rolling. The edge drop or edge-up in the strip end area is greatly affected by the metal flow in the vicinity of the strip end portion in width direction and roll flattening.

For this reason, to control the strip crown of the rolling material to a desired profile across the whole in the strip width direction, the edge drop or edge-up needs to be controlled to a predetermined value or smaller. In addition, the strip shape needs to be caused to fall within an allowable range and the strip crown also needs to be controlled to a predetermined value or smaller.

In general, it is deemed that the edge drop or edge-up in hot rolling is affected by the operation condition of only the relevant stand and the influence of upstream-side stands is small. That is, it is deemed that the hereditary property of the edge drop or edge-up is small but this is not based on quantitative evaluation.

Figure 2:
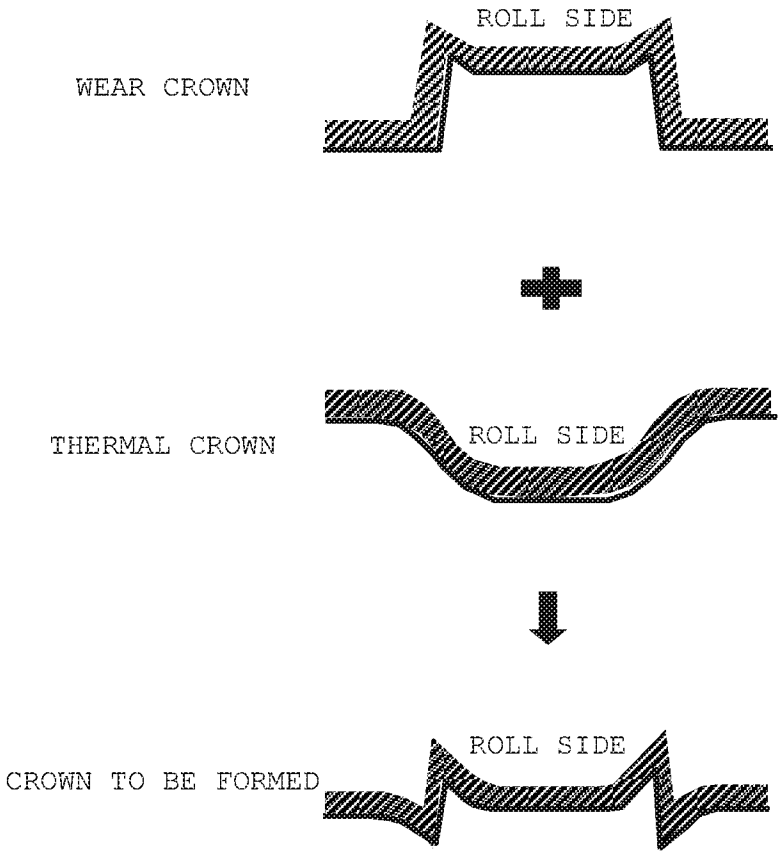
FIG. 2 is a diagram for explaining the principle of a roll profile based on a thermal crown and a wear crown of a work roll part of the hot finishing tandem rolling mill.

Furthermore, when the number of rolling materials increases, roll wear increases as shown in FIG. 2. In particular, an edge-up is generated at the strip end portion in width direction due to local wear at the strip end portion in width direction and a thermal crown attributed to roll thermal expansion.

Because it is deemed that the hereditary property of the edge drop or edge-up is small as described above, the edge drop or edge-up can be suppressed by changing the operation condition of the last stand.

Furthermore, normally, operation in which the reduction in thickness is small is carried out at the last stand. When the rolling force per unit width becomes smaller, roll flattening deformation in the vicinity of the strip end portion in width direction becomes smaller. For this reason, when this operation method in which the reduction in thickness is small is used, although the strip crown can be set to the predetermined value while the strip shape is kept within the allowable range, the effect of suppressing the edge-up generated due to the roll thermal crown and wear at the last stand becomes small, so that the edge profile cannot be controlled to the predetermined value.

So, in the present invention, the following control is employed. Specifically, based on the relationship between the strip crown and the edge drop or edge-up on the last stand outlet side, preferably with the above-described relationship obtained in advance, a reduction device is controlled to adjust the rolling force per unit width at the last stand and a strip shape control actuator at the last stand of a hot finishing tandem rolling mill is operated to cause the strip shape to fall within the allowable range and adjust the strip crown to the predetermined value or smaller. By this method, the strip crown and the edge profile can be adjusted to the predetermined value or smaller and a favorable strip profile can be obtained.

Furthermore, the following method is employed. Specifically, if it is not easy to cause the strip shape to fall within the allowable range and control the strip crown to the predetermined value or smaller only by the strip shape control actuator at the last stand, adjustment is carried out to obtain a predetermined strip crown while giving priority to the strip shape from the finish latter stage side sequentially.

Moreover, the following control is employed. Specifically, a work roll polishing device is disposed and the roll surfaces of the work rolls of the last stand are improved to thereby cause the strip shape to fall within the allowable range and adjust the strip crown to the predetermined value or smaller more easily.

Embodiments of the strip profile control method of a hot finishing tandem rolling mill and the hot finishing tandem rolling mill according to the present invention based on the above-described studies will be described below by using the drawings.

Embodiment 1

Figure 3:
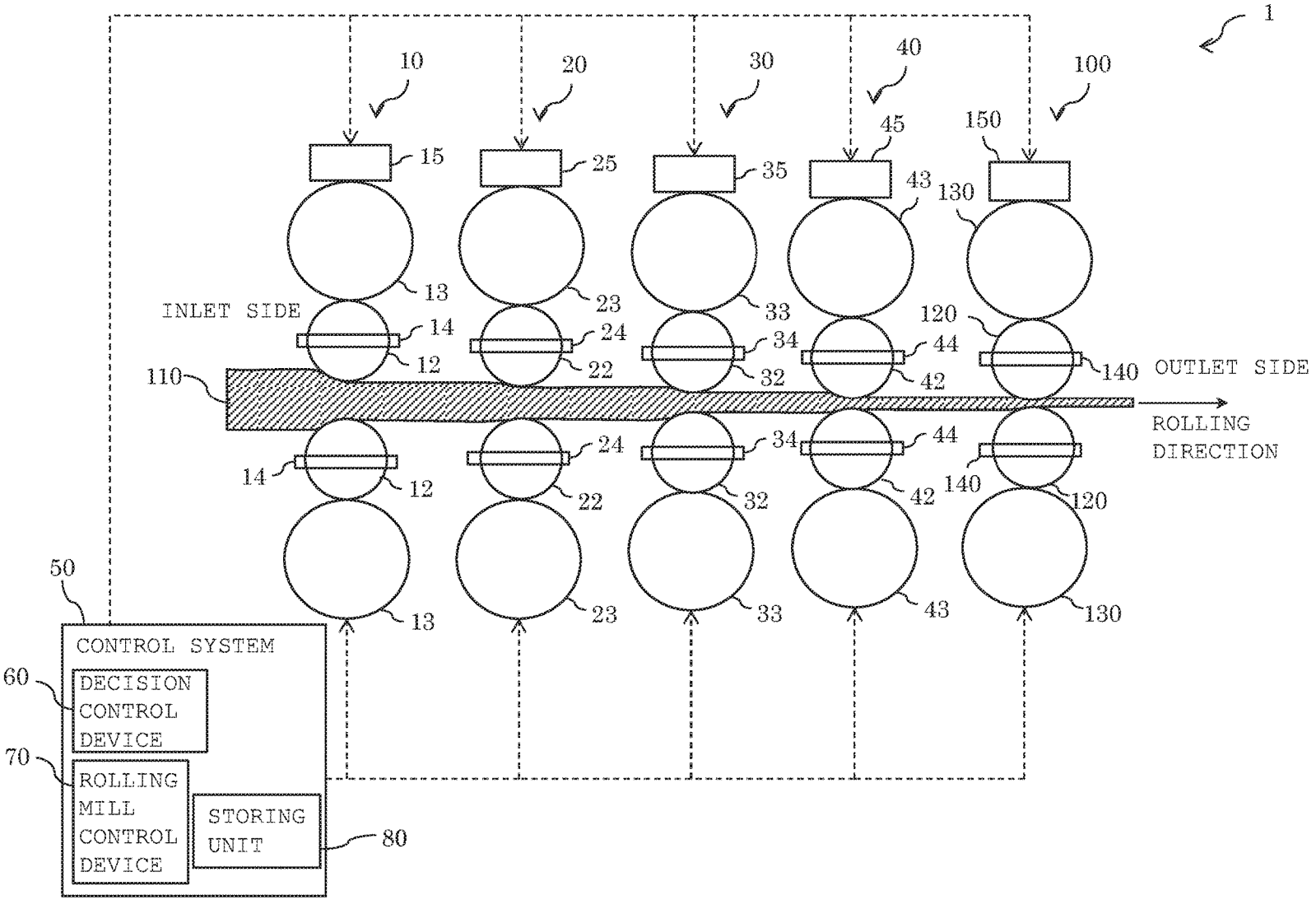
FIG. 3 is a diagram showing the outline of a hot finishing tandem rolling mill of embodiment 1.

Embodiment 1 of the strip profile control method of a hot finishing tandem rolling mill and the hot finishing tandem rolling mill according to the present invention will be described by using FIG. 3 to FIG. 22. First, a hot finishing tandem rolling mill 1 will be described by using FIG. 3. FIG. 3 is a diagram showing the outline of the hot finishing tandem rolling mill.

As shown in FIG. 3, the hot finishing tandem rolling mill 1 is a rolling mill that carries out hot rolling of a hot rolling material 110 into a strip, and has five stands, an F1 stand 10, an F2 stand 20, an F3 stand 30, an F4 stand 40, and an F5 stand 100, and a control system 50. The hot finishing tandem rolling mill 1 is not limited to five stands like those shown in FIG. 3 and it suffices that the hot finishing tandem rolling mill 1 is a rolling mill formed of at least two stands.

The F1 stand 10 has a pair of upper and lower work rolls 12, 12, a pair of upper and lower back-up rolls 13, 13, a pair of upper and lower work roll benders 14, 14, and a reduction device 15. The F2 stand 20 has a pair of upper and lower work rolls 22, 22, a pair of upper and lower back-up rolls 23, 23, a pair of upper and lower work roll benders 24, 24, and a reduction device 25. The F3 stand 30 has a pair of upper and lower work rolls 32, 32, a pair of upper and lower back-up rolls 33, 33, a pair of upper and lower work roll benders 34, 34, and a reduction device 35. The F4 stand 40 has a pair of upper and lower work rolls 42, 42, a pair of upper and lower back-up rolls 43, 43, a pair of upper and lower work roll benders 44, 44, and a reduction device 45. The F5 stand 100 serving as the last stand has a pair of upper and lower work rolls 120, 120, a pair of upper and lower back-up rolls 130, 130, a pair of upper and lower work roll benders 140, 140, and a reduction device 150.

The work rolls 12, 22, 32, 42, and 120 carry out rolling of the hot rolling material 110. The back-up rolls 13, 23, 33, 43, and 130 support the corresponding work rolls 12, 22, 32, 42, and 120, respectively.

The work rolls 12, 22, 32, 42, and 120 and the back-up rolls 13, 23, 33, 43, and 130 on the upper side and the work rolls 12, 22, 32, 42, and 120 and the back-up rolls 13, 23, 33, 43, and 130 on the lower side are pair cross rolls that can cross each other in a horizontal plane.

The work roll benders (strip shape control actuators) 14, 24, 34, 44, and 140 are devices for giving a bending force to the work rolls 12, 22, 32, 42, and 120, and can modify the shape of the section of the hot rolling material 110, particularly the strip crown and the flatness, by changing the bending force.

The reduction devices 15, 25, 35, 45, and 150 are devices that individually give a reduction force to the corresponding back-up rolls 13, 23, 33, 43, and 130.

The control system 50 has a decision control device 60 that decides a predetermined pass schedule, a rolling mill control device 70 that controls the reduction devices 15, 25, 35, 45, and 150, the work roll benders 14, 24, 34, 44, and 140, and a cross angle change actuator (not shown) based on the predetermined pass schedule decided in the decision control device 60, and a storing unit 80 that stores the relationship between the strip crown and the edge profile on the outlet side of the last stand 100 with respect to the rolling force per unit width and a flatness control parameter (hereinafter, referred to as strip shape control parameter), obtained regarding the last stand 100 of the hot finishing tandem rolling mill 1 in advance.

Here, in the present embodiment, the work roll benders 140 are employed as the strip shape control actuators of the last stand 100 and the work roll bending force of the work roll benders 140 is employed as the strip shape control parameter.

A cross angle change actuator may be employed as the strip shape control actuator of the last stand 100 and a roll cross angle may be employed as the strip shape control parameter. Furthermore, a roll shift actuator may be employed as the strip shape control actuator of the last stand 100 and the amount of roll shift may be employed as the strip shape control parameter. Moreover, it is also possible to employ the work roll benders 140 and the cross angle change actuator or the roll shift actuator as the strip shape control actuators of the last stand 100 and employ the work roll bending force and the roll cross angle or the amount of roll shift as the strip shape control parameters.

Regarding an existing pass schedule of the hot finishing tandem rolling mill 1, the decision control device 60 decides an intermediate pass schedule by adjusting the rolling force per unit width at the last stand 100 to cause the edge profile on the outlet side of the last stand 100 to fall within the allowable range based on the relationship between the strip crown and the edge profile on the outlet side of the last stand 100 with respect to the rolling force per unit width and the work roll bending force of the work roll benders 140, stored in the storing unit 80. Furthermore, regarding the intermediate pass schedule, the decision control device 60 adjusts the work roll bending force of the work roll benders 140 to cause the strip shape on the outlet side of the last stand 100 to fall within the allowable range and cause the strip crown to become the predetermined value or smaller. Then, the decision control device 60 decides the pass schedule (predetermined pass schedule) of the plural stands (F1 stand 10 to F5 stand 100) based on the rolling force per unit width at the last stand 100 and the work roll bending force of the work roll benders 140 that are adjusted.

In particular, in deciding the predetermined pass schedule, if it is determined that the strip shape on the outlet side of the last stand 100 does not fall within the allowable range or the strip crown does not become the predetermined value or smaller only by the adjustment of the work roll bending force of the work roll benders 140 of the last stand 100, the decision control device 60 adjusts the work roll bending force of the work roll benders 14, 24, 34, and 44 of the upstream-side stands (F1 stand 10 to F4 stand 40) to cause the strip shape at the last stand 100 to fall within the allowable range and cause the strip crown to become the predetermined value or smaller from the side of the last stand 100 toward the upstream side sequentially.

Furthermore, when deciding the predetermined pass schedule, the decision control device 60 obtains the amount of reduction in thickness at the last stand 100 for realizing the rolling force per unit width at the last stand 100 and decides a reduction schedule to cause the strip shape to fall within the allowable range based on this amount of reduction in thickness.

The rolling mill control device 70 controls the reduction devices 15, 25, 35, 45, and 150 of the respective stands to obtain the adjusted rolling force per unit width at the last stand 100, and controls the work roll benders 14, 24, 34, 44, and 140 of the respective stands to obtain the adjusted strip shape control parameter of the last stand 100.

Next, description will be made below about one example of the relationship between the strip crown and the edge profile on the outlet side of the last stand 100 with respect to the rolling force per unit width and the work roll bending force of the work roll benders 140, used to decide the predetermined pass schedule in the decision control device 60, a method for adjusting the rolling force per unit width at the last stand 100 to cause the edge profile to fall within the allowable range, and a method for adjusting the work roll bending force of the work roll benders 140 of the last stand 100 to cause the strip shape on the outlet side of the last stand 100 to fall within the allowable range and cause the strip crown to become the predetermined value or smaller.

First, results of studies made by the present inventors regarding edge drop hereditary characteristics will be described.

Figure 5:
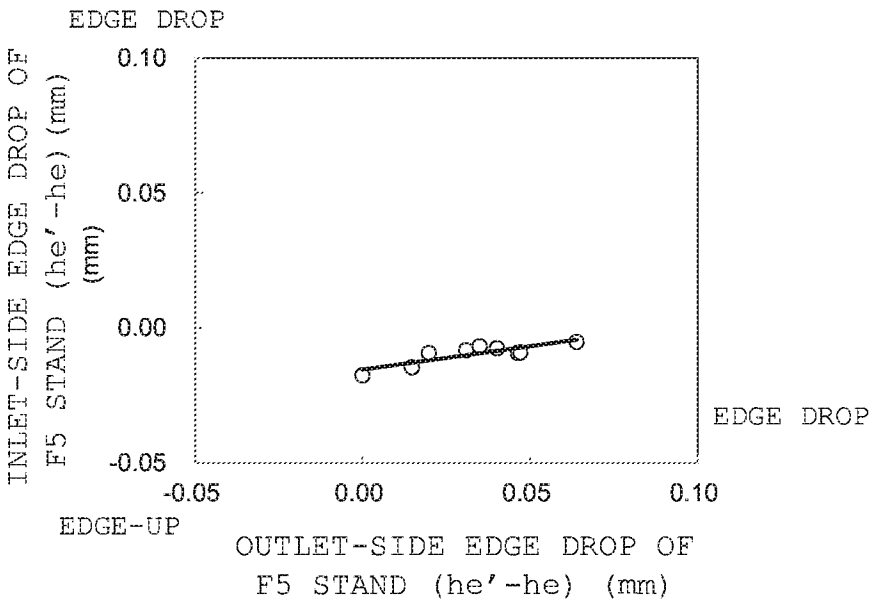
FIG. 5 is a diagram showing the hereditary property of the edge drop at a last stand of the hot finishing tandem rolling mill.

At first, the strip profile in the hot finishing tandem rolling mill was calculated by using a finite element method and the relationship between the amount of inlet-side edge drop and the amount of outlet-side edge drop was marshaled. The calculation condition is shown in Table 1 and the result of the calculation is shown in FIG. 5.

TABLE 1

| | |
|---|---|
| Work roll diameter (mm) | 680 |
| Back-up roll diameter (mm) | 1450 |
| Finished strip thickness (mm) | 4.88 |
| Strip width (mm) | 1577 |
| Rolling force (kN) | 10618 |

As shown in Table 1, the following condition was employed: the work roll diameter was 680 mm, the back-up roll diameter was 1450 mm, the strip width was 1577 mm, and the finished strip thickness was 4.88 mm. Furthermore, in the calculation, work roll profiles of −37.5 μm/rad for a thermal crown and −25 μm/rad for a wear crown were considered.

Here, the thermal crown is a phenomenon in which the work roll thermally expands to become larger due to contact with the strip, and a condition that the diameter of the work roll increased by about 37.5 μm per radius in the area to positions of 100 mm from the strip ends was employed. The thermal crown is defined as a deviation from the strip center here. Furthermore, the wear crown is a phenomenon in which the work roll locally wears in the strip end portion in width direction due to contact with the strip, and a condition that the diameter of the work roll decreased by about 25 μm per radius in the strip end portion in width direction was employed. The wear crown is defined as a deviation from the strip center here.

Figure 4:
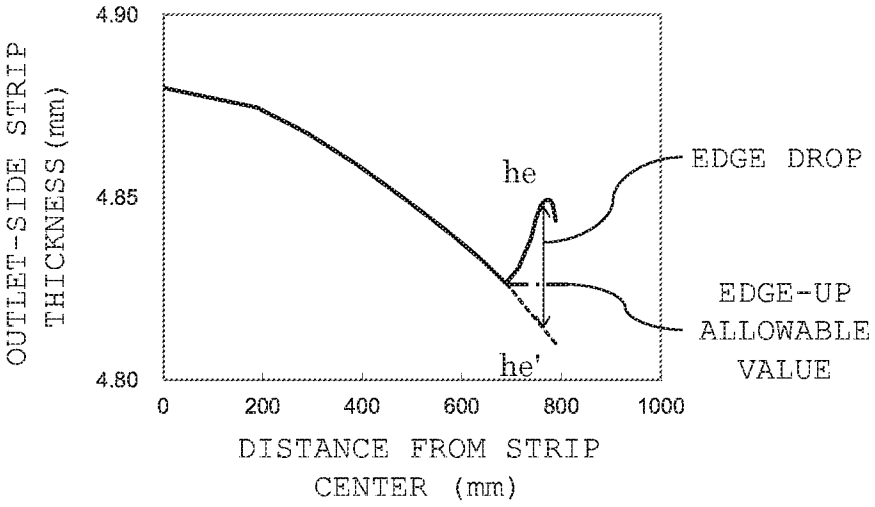
FIG. 4 is a diagram showing the definitions of a strip crown and an edge drop and an edge-up in the hot finishing tandem rolling mill.

Furthermore, as shown in FIG. 4, the difference (Ch100) between the strip thickness at the position of 100 mm from the strip end and the strip thickness at the strip central portion was employed as the detailed definition of the strip crown. Regarding the detailed definition of the edge drop or edge-up, a polynomial approximation was performed from the strip thickness distribution from the strip center to the position of 100 mm from the strip end and the strip thickness at a position of 25 mm from the strip end (strip thickness 25 mm, he') was estimated, and the edge drop or edge-up was evaluated as the difference from the actual strip thickness (he) at the position of 25 mm from the strip end. If the strip thickness at the position of 100 mm from the strip end was larger than the strip thickness at the position of 25 mm from the strip end, the difference was allowed to be permitted as the edge-up.

As shown in FIG. 5, as the result of marshaling the relationship between the inlet-side edge drop and the outlet-side edge drop of the last stand 100, it turned out that both were in a linear relationship. Furthermore, it also turned out that the hereditary property of the edge drop, which was the slope of the linear relationship, was as low as 0.17. That is, even when the edge drop on the inlet side changes, only 17% thereof affects the edge drop on the outlet side. From this, it quantitatively turns out that the edge-up or edge drop characteristics are substantially determined by only the relevant stand.

Figure 6:
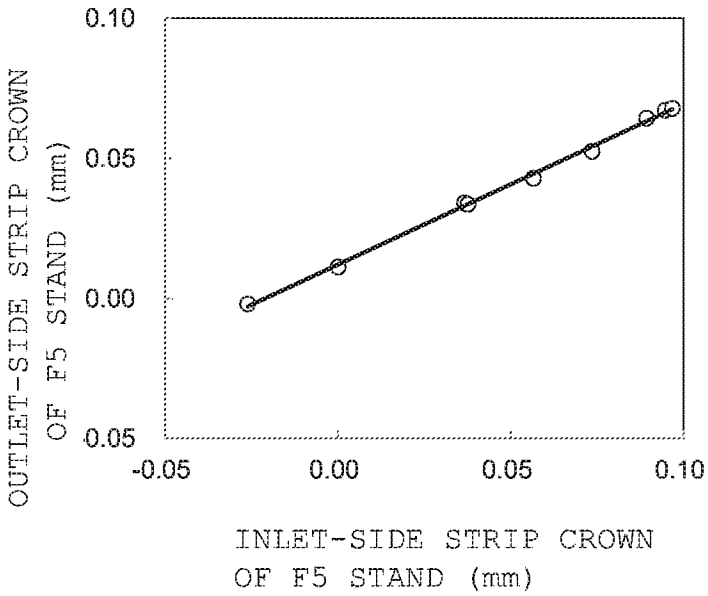
FIG. 6 is a diagram showing the hereditary property of the strip crown at the last stand of the hot finishing tandem rolling mill.

The relationship between the inlet-side strip crown and the outlet-side strip crown of the last stand 100 was also marshaled. The result thereof is shown in FIG. 6. As shown in FIG. 6, it turned out that both were in a linear relationship and the hereditary property of the strip crown, which was the slope of the linear relationship, was as high as 0.56 differently from the relationship between the inlet-side edge drop and the outlet-side edge drop of the last stand 100. That is, it turned out that 56% of the strip crown on the inlet side affected the strip crown on the outlet side.

Figure 7:
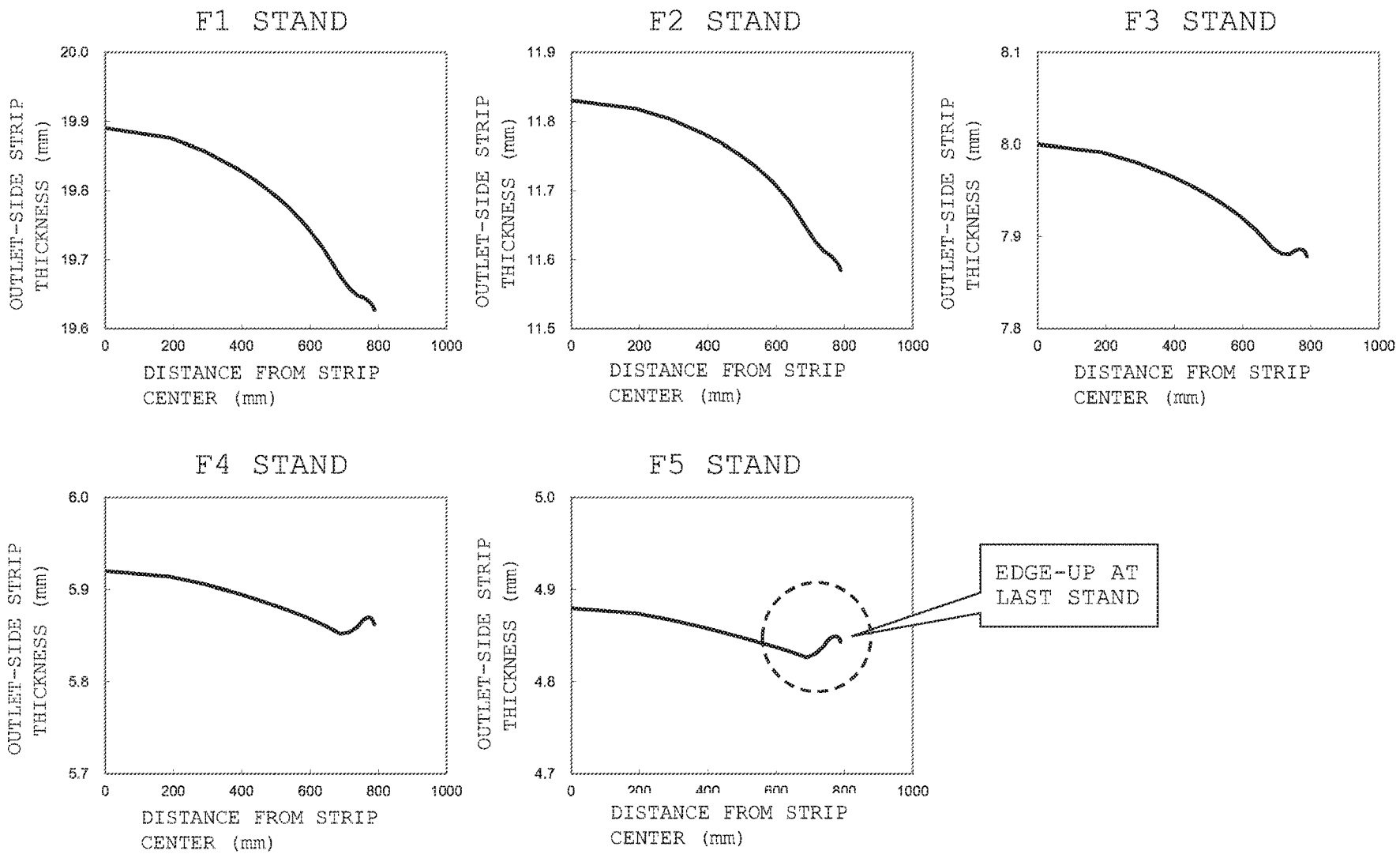
FIG. 7 is a diagram showing a calculation result of the strip profile on the outlet side of the respective stands under a condition shown in Table 2 in embodiment 1 of the present invention.

Next, a calculation of the rolled steel strip profile in the hot finishing tandem rolling mill 1 under a condition in which only the thermal crown and the wear crown were considered was performed. The condition of this calculation is shown in Table 2 and the result is shown in FIG. 7. Table 2 shows a condition in which the rolling force per unit width at the last stand 100 is set to 6.7 kN/mm and this condition is defined as tandem rolling calculation condition 1 (corresponding to the existing pass schedule).

TABLE 2

| | F1 stand | F2 stand | F3 stand | F4 stand | F5 stand |
|---|---|---|---|---|---|
| Work roll diameter (mm) | 825 | 825 | 680 | 680 | 680 |
| Back-up roll diameter (mm) | 1450 | 1450 | 1450 | 1450 | 1450 |
| Strip width (mm) | 1577 | 1577 | 1577 | 1577 | 1577 |
| Inlet-side strip thickness (mm) | 31.00 | 19.89 | 11.83 | 8.0 | 5.92 |
| Outlet-side strip thickness (mm) | 19.89 | 11.83 | 8.0 | 5.92 | 4.88 |
| The amount of reduction in thickness (mm) | 11.11 | 8.06 | 3.83 | 2.08 | 1.04 |

TABLE 2-continued

| | F1 stand | F2 stand | F3 stand | F4 stand | F5 stand |
|---|---|---|---|---|---|
| Reduction in thickness (%) | 36 | 41 | 32 | 26 | 18 |
| Rolling force (kN) | 27430 | 26293 | 17728 | 14161 | 10618 |
| Rolling force per unit width (kN/mm) | 17.4 | 16.7 | 11.2 | 9.0 | 6.7 |
| Work roll bending force (kN/chock) | 823 | 823 | 823 | 823 | 902 |
| Cross angle (deg) | 0.31 | 0.33 | 0.30 | 0.31 | 0.0 |

Figure 8:
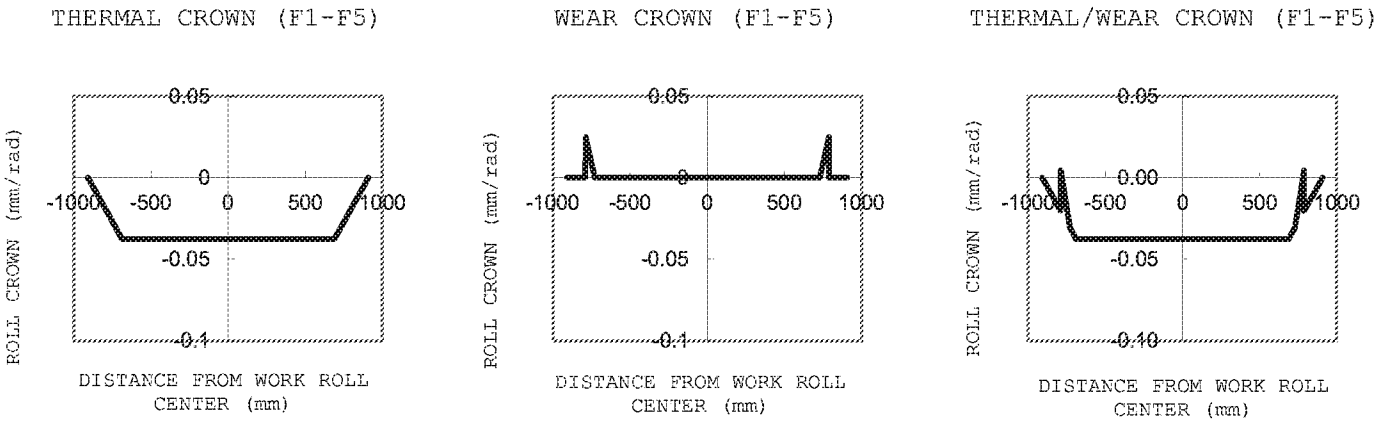
FIG. 8 is a diagram showing the setting of a thermal crown and a wear crown of work rolls of the respective stands in Table 2.

Regarding the thermal crown, the wear crown, and the initial crown of the work rolls 12, 22, 32, 42, and 120 of the F1 stand 10 to the F5 stand 100, the following profiles were considered as shown in FIG. 8: −37.5 μm/rad for the thermal crown (position of 100 mm from the strip end), −25 μm/rad for the wear crown (position of 60 mm from the strip end), and −140 μm/rad for the initial crown.

As shown in FIG. 7, it turned out that the rolled steel strip profile was affected by the thermal crown and local wear depending on the wear crown to a larger extent as the rolling position came closer to the latter stage and the result was the occurrence of an edge-up in the vicinity of the strip end portion in width direction.

Figure 9:
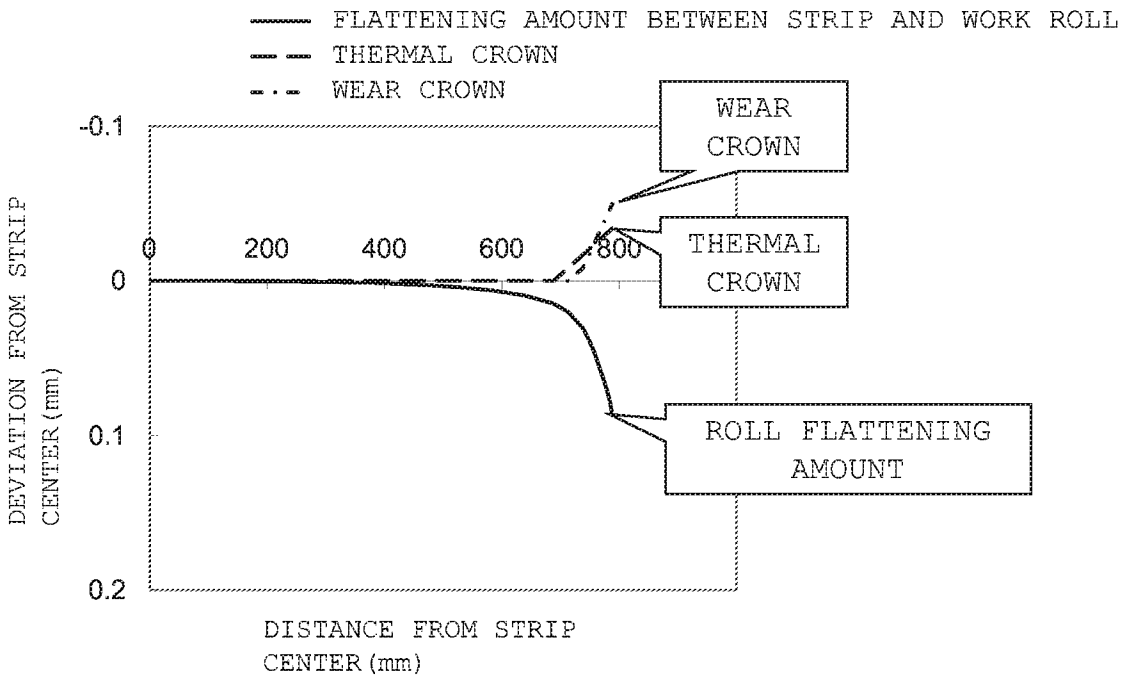
FIG. 9 is a diagram showing a calculation result of the thermal crown, the wear crown, and the work roll flattening distribution of the last stand.
Figure 10:
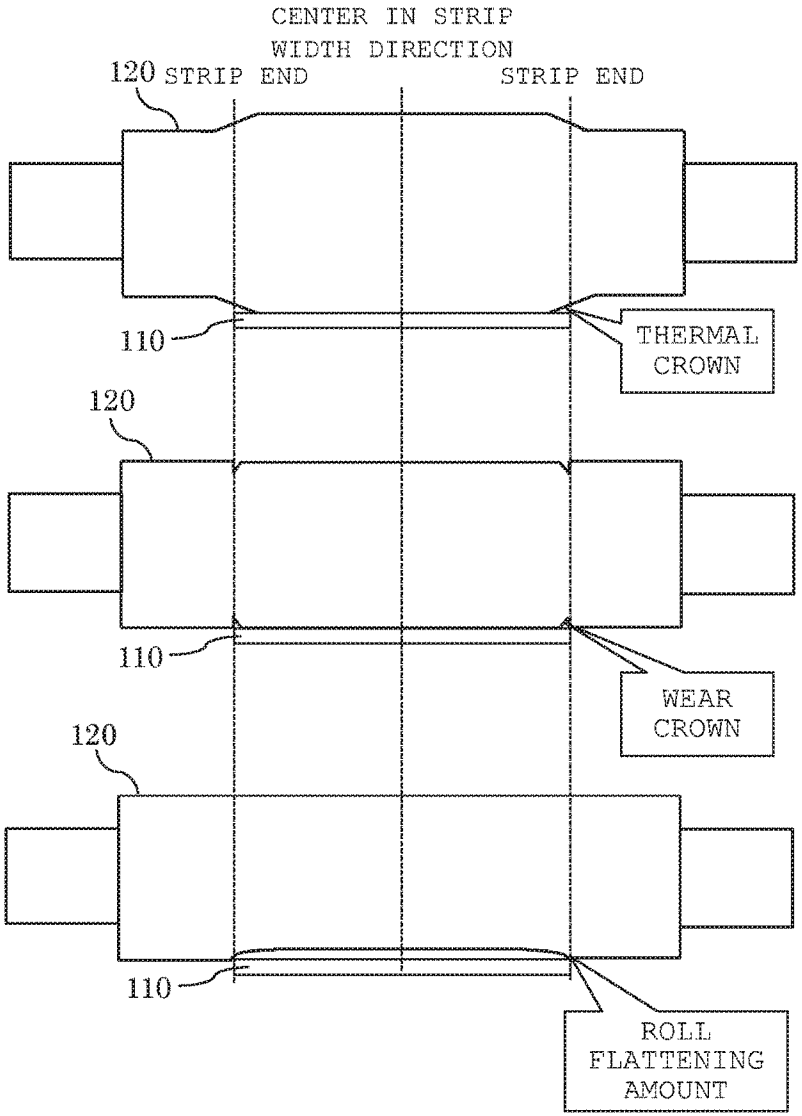
FIG. 10 is a diagram showing the relationship among the thermal crown, the wear crown, and the work roll flattening distribution of the last stand.

Furthermore, in FIG. 9, the calculation result of the thermal crown, the wear crown, and the work roll flattening distribution at the last stand is shown. Here, the roll flattening distribution is the distribution of the amount of roll surface flattening in the strip width direction when the force distribution from the strip acts on the work roll 120 as shown on the lowermost row in FIG. 10. Here, the roll flattening distribution is defined as a deviation from the strip center. For reference, the outline of the thermal crown and the wear crown is also shown in FIG. 10.

As shown in FIG. 9, it turned out that, although the total of the thermal crown and the wear crown suddenly changed at the strip end portion in width direction, change in the amount of roll flattening was gentler compared with the total of the crowns and an edge-up occurred as a result.

Figure 11:
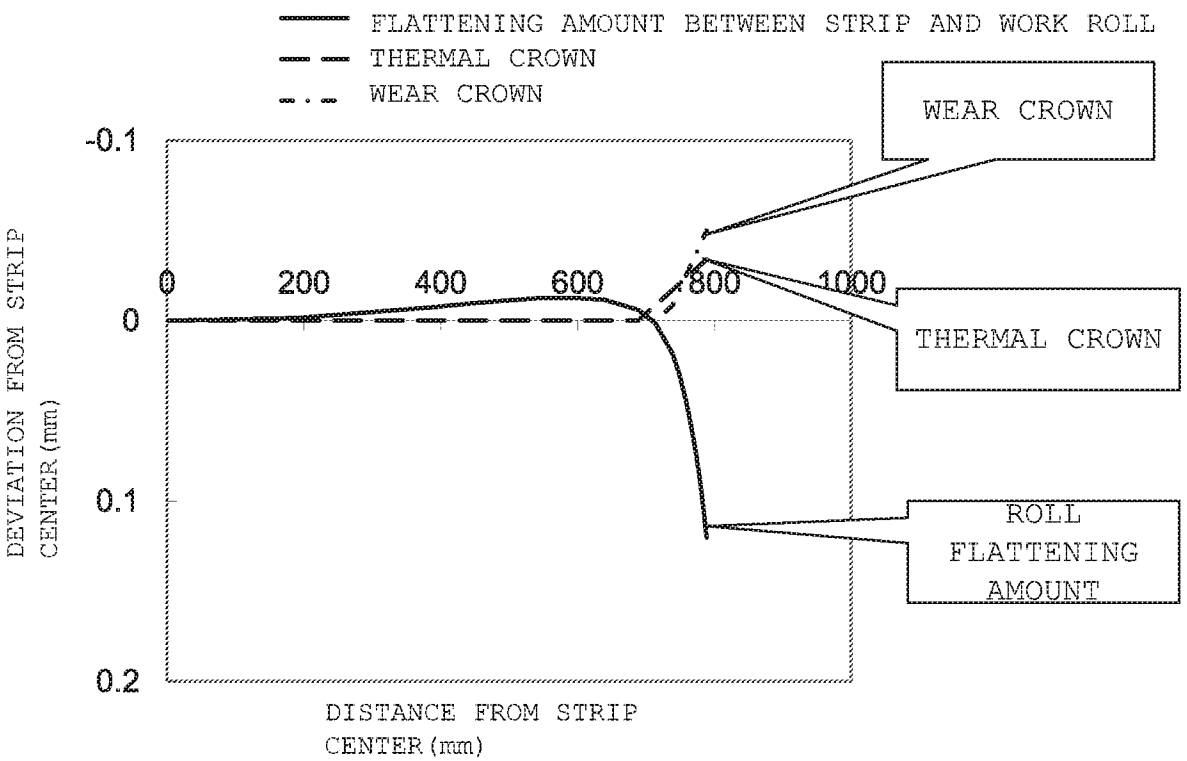
FIG. 11 is a diagram showing a calculation result of the thermal crown, the wear crown, and the work roll flattening distribution under a condition in which the rolling force per unit width is set to 12.9 kN/mm at the last stand, shown in Table 3 of embodiment 1.
Figure 12:
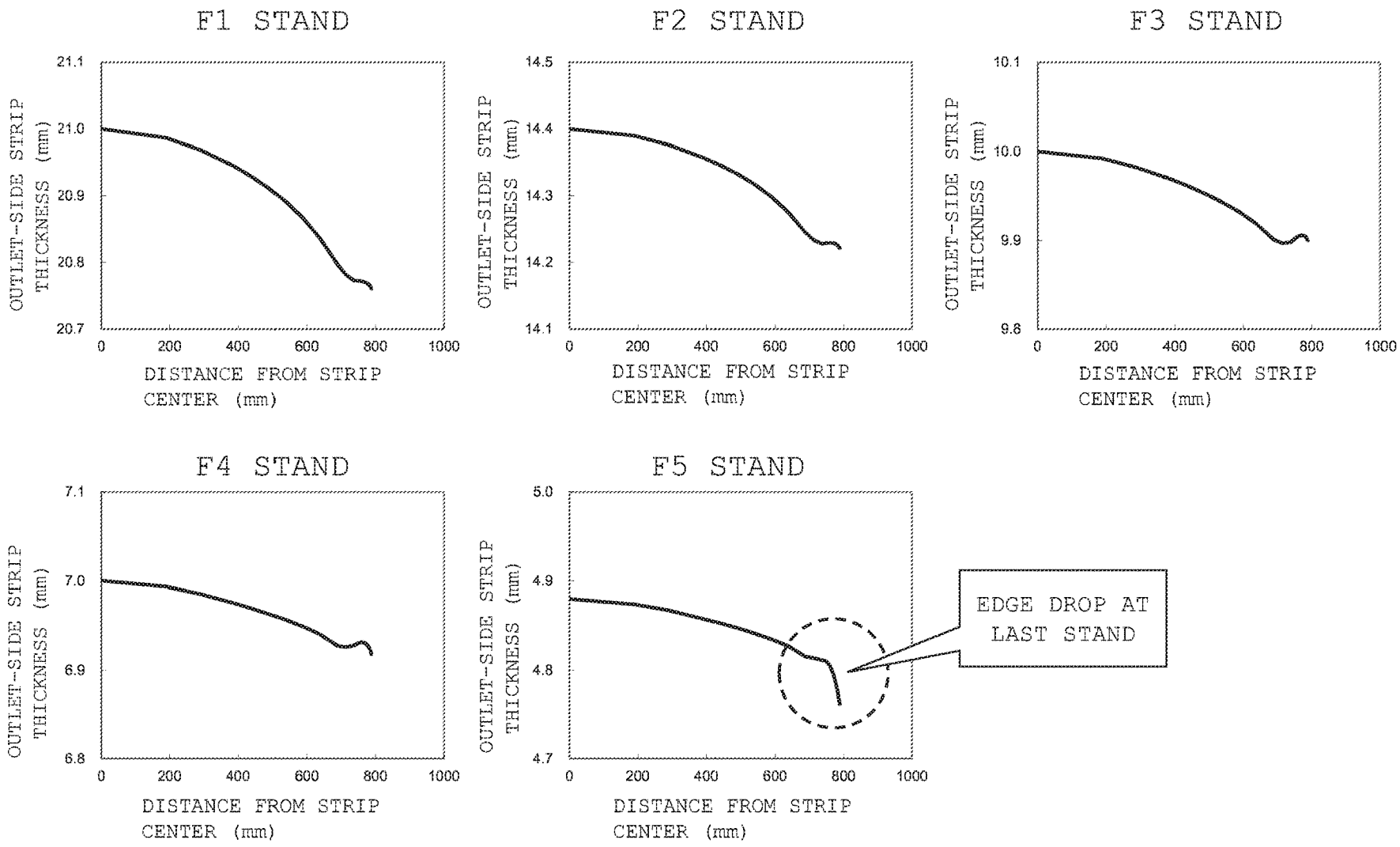
FIG. 12 is a diagram showing a calculation result of the strip profile on the outlet side of the respective stands under the condition in which the rolling force per unit width is set to 12.9 kN/mm at the last stand, shown in Table 3 of embodiment 1.

In response to this result, for edge-up suppression, a calculation of the rolled steel strip profile in the hot finishing tandem rolling mill 1 when the reduction in thickness at the last stand 100 was raised to increase the rolling force per unit width to 12.9 kN/mm was performed. The condition of this calculation is shown in Table 3 and the result is shown in FIG. 11 and FIG. 12. Table 3 shows a condition in which the rolling force per unit width at the last stand 100 is set to 12.9 kN/mm and this condition is defined as tandem rolling calculation condition 2 (intermediate pass schedule).

TABLE 3

| | F1 stand | F2 stand | F3 stand | F4 stand | F5 stand |
|---|---|---|---|---|---|
| Work roll diameter (mm) | 825 | 825 | 680 | 680 | 680 |
| Back-up roll diameter (mm) | 1450 | 1450 | 1450 | 1450 | 1450 |
| Strip width (mm) | 1577 | 1577 | 1577 | 1577 | 1577 |
| Inlet-side strip thickness (mm) | 31.0 | 21.0 | 14.4 | 10.0 | 7.0 |
| Outlet-side strip thickness (mm) | 21.0 | 14.4 | 10.0 | 7.0 | 4.88 |
| The amount of reduction in thickness (mm) | 10.0 | 6.6 | 4.4 | 3.0 | 2.12 |
| Reduction in thickness (%) | 33 | 31 | 31 | 30 | 30 |
| Rolling force (kN) | 24343 | 19669 | 17130 | 17130 | 20384 |
| Rolling force per unit width (kN/mm) | 15.4 | 12.5 | 10.9 | 10.9 | 12.9 |
| Work roll bending force (kN/chock) | 823 | 823 | 823 | 823 | 902 |
| Cross angle (deg) | 0.31 | 0.33 | 0.30 | 0.31 | 0.0 |

In Table 3, for the pass schedule, the inlet-side strip thickness and the finished strip thickness in the whole of the hot finishing tandem rolling mill 1 were set the same as tandem rolling calculation condition 1 shown in Table 2, and the reduction in thickness at the last stand 100 was so adjusted that the rolling force per unit width became 12.9 kN/mm. Furthermore, the outlet-side strip thickness of the respective stands excluding the last stand 100 was so adjusted that the strip shape fell within a predetermined range and the reduction in thickness was around 30%.

As shown in FIG. 11, it turned out that the amount of roll flattening in the vicinity of the strip end portion in width direction rapidly changed relative to the thermal crown and the wear crown when the force per unit width at the last stand 100 was increased to 12.9 kN/mm. Furthermore, it turned out that, because of the change in the amount of roll flattening, the edge-up at the last stand 100 could be suppressed and an edge drop occurred as shown in FIG. 12.

Figure 13:
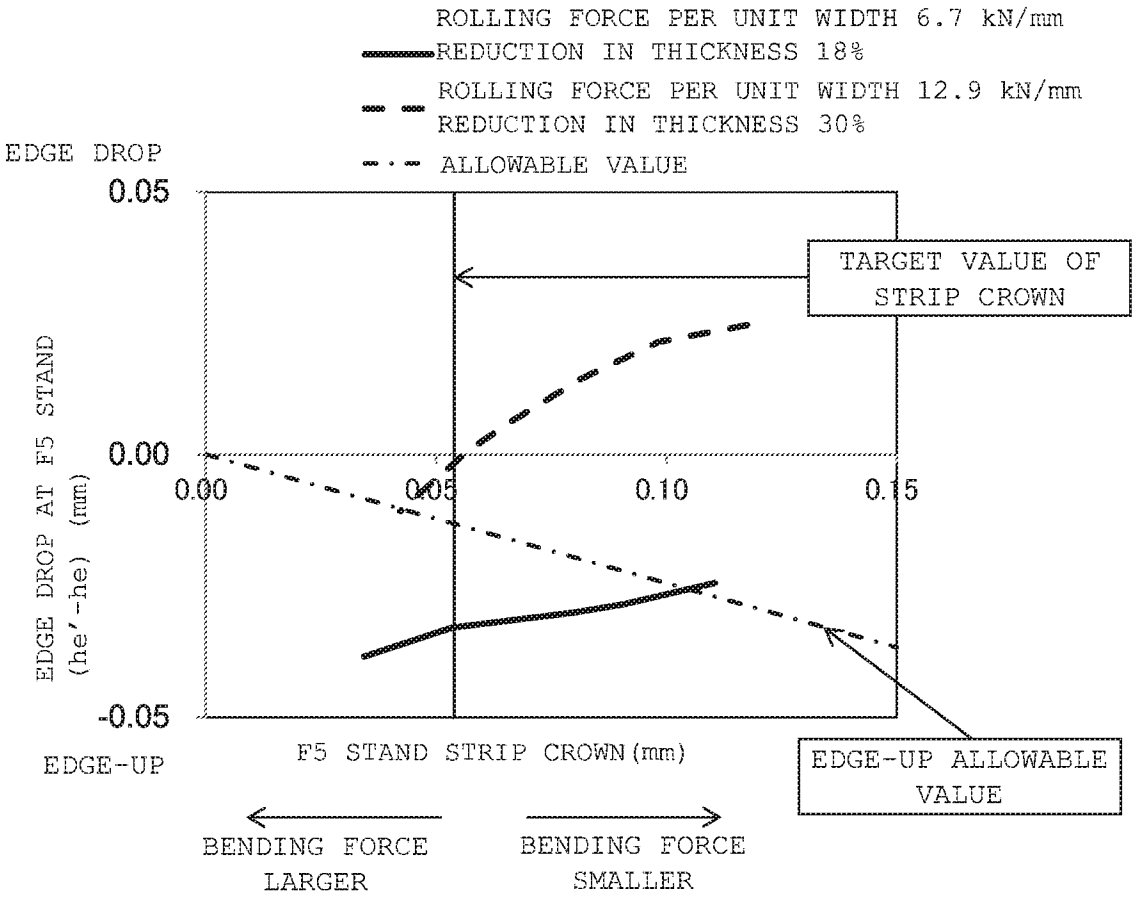
FIG. 13 is a diagram showing the between the strip crown and the edge profile regarding each rolling force per unit width at the last stand in embodiment 1.

Based on these results, the relationships between the strip crown at the position of 100 mm from the strip end and the edge drop or edge-up at the position of 25 mm from the strip end at the last stand 100 were obtained in such a manner that the rolling force per unit width at the last stand 100 was set to two conditions of 6.7 kN/mm and 12.9 kN/mm and the setting of the work roll benders 140, which are the strip shape control actuators at the last stand 100, was changed under each condition of the rolling force per unit width, and the obtained relationships were marshaled as shown in FIG. 13.

As shown in FIG. 13, it turned out that the strip crown became smaller when the bending force by the work roll benders 140 at the last stand 100 was increased and the strip crown became larger when the bending force by the work roll benders 140 was weakened. Furthermore, it turned out that the edge-up became smaller when the rolling force per unit width at the last stand 100 was increased and the edge-up also became smaller when the bending force given by the work roll benders 140 was weakened to make the strip crown larger.

It turns out that, if the target value of the strip crown on the outlet side of the last stand 100 is set to 0.055 mm as shown in FIG. 13, when the rolling force per unit width at the last stand 100 is 6.7 kN/mm, the condition under which the edge-up can be suppressed within the allowable range does not exist even when the work roll benders 140 are changed in order to set the strip crown to the predetermined value or smaller.

Therefore, it turns out that the rolling force per unit width at the last stand 100 needs to be raised to cause the edge-up to fall within the allowable range, specifically for example the rolling force per unit width at the last stand 100 needs to be raised to 12.9 kN/mm to set the edge-up to 0.

As above, it turns out that the edge profile falls within the allowable range easily and surely and the strip shape on the outlet side of the last stand 100 falls within the allowable range and the strip crown can be set to the predetermined value or smaller by obtaining the relationship between the strip crown and the edge drop or edge-up at the last stand 100 with respect to the rolling force per unit width and the work roll bending force of the work roll benders 140 and deciding the necessary rolling force per unit width at the last stand 100 from the predetermined strip crown.

Figure 14:
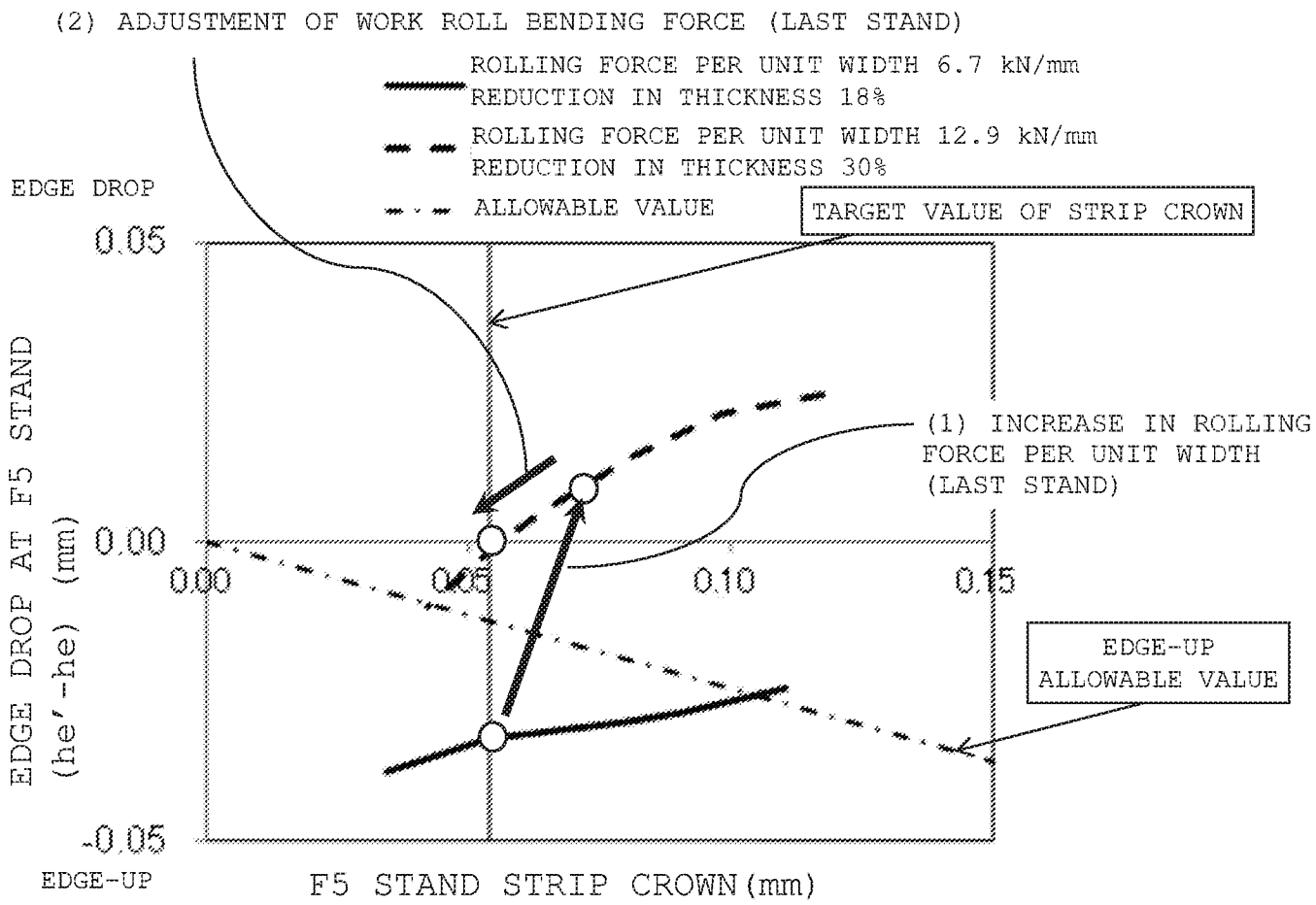
FIG. 14 is a diagram showing one example of strip profile control by increase in the rolling force per unit width and adjustment of the work roll bending force at the last stand in embodiment 1.
Figure 15:
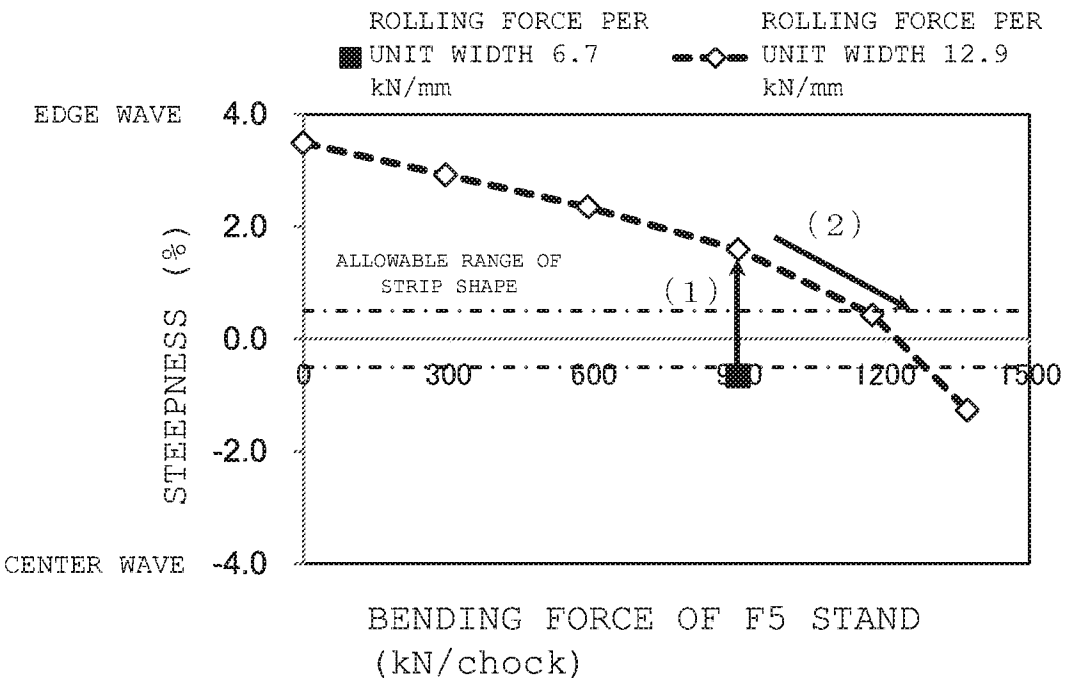
FIG. 15 is a diagram showing change in the steepness due to the increase in the rolling force per unit width and the adjustment of the work roll bending force at the last stand in embodiment 1.

The relationship between the strip crown at the position of 100 mm from the strip end and the edge profile at the position of 25 mm from the strip end when the rolling force per unit width at the last stand 100 is raised from 6.7 kN/mm to 12.9 kN/mm is shown in FIG. 14. The relationship between the bending force at the work rolls 120 at the last stand 100 (F5) and the steepness (represented by the ratio of a wave height H to a pitch L at the strip end portion in width direction in the rolling direction of the rolling material) as the strip shape at the last stand 100 is shown in FIG. 15. The relationship between the work roll benders 140 of the last stand 100 and the strip crown at the position of 100 mm from the strip end is shown in FIG. 16.

Figure 16:
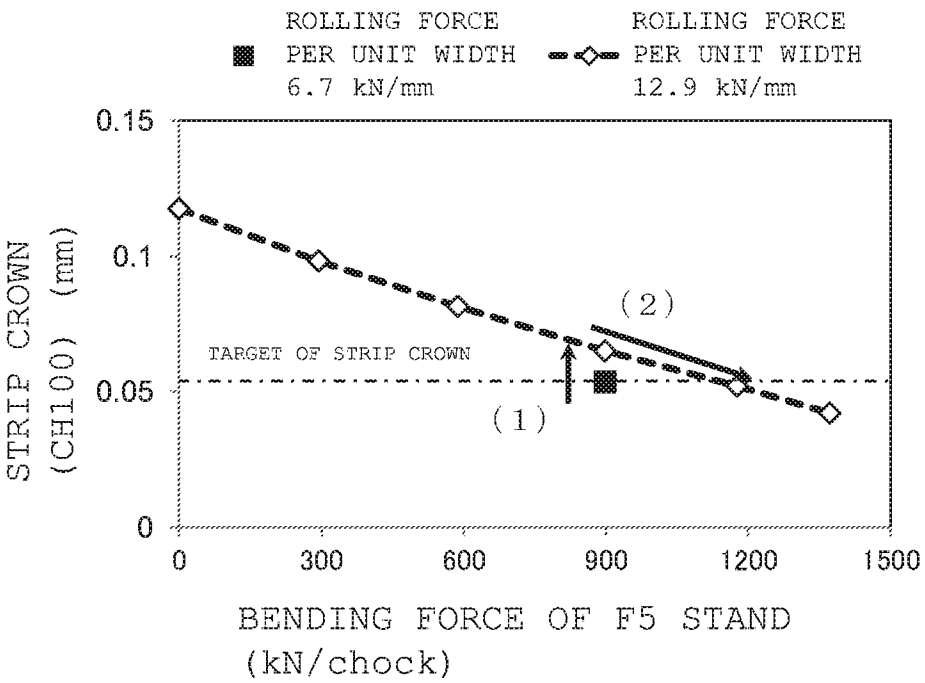
FIG. 16 is a diagram showing change in the strip crown due to the increase in the rolling force per unit width and the adjustment of the work roll bending force at the last stand in embodiment 1.

When the rolling force per unit width at the last stand 100 is raised from 6.7 kN/mm to 12.9 kN/mm while the bending force is kept at 902 kN/chock (corresponding to (1) in FIGS. 14, 15, and 16), the strip crown becomes larger as shown in FIG. 14 and FIG. 16 and the steepness shows a tendency toward edge waves as shown in FIG. 15.

When the predetermined value of the strip crown is set to 0.055 mm or smaller and a range within ±0.5% is employed as the restriction of the steepness, the result that deviates from the predetermined value is obtained regarding both, and adjustment by the work roll benders 140 as the strip shape control actuators is necessary.

Specifically, because the strip crown is larger than the predetermined value, the work roll bending force by the work roll benders 140 at the F5 stand 100 needs to be changed toward the increase side. So, the work roll bending force of the F5 stand 100 is raised from 902 kN/chock to 1176 kN/chock (corresponding to (2) in FIGS. 14, 15, and 16). By this change, the steepness can be set to about +0.5% and the strip crown can be set to 0.055 mm or smaller. Thus, it turns out that control to the predetermined strip crown becomes possible while the strip shape is kept within the predetermined range. The calculation condition at this time is shown in Table 4. This Table 4 shows the condition after the increase in the rolling force per unit width+the adjustment of the work roll bending force and this condition is defined as tandem rolling calculation condition 3 (corresponding to the final pass schedule).

TABLE 4

| | F1 stand | F2 stand | F3 stand | F4 stand | F5 stand |
|---|---|---|---|---|---|
| Work roll diameter (mm) | 825 | 825 | 680 | 680 | 680 |
| Back-up roll diameter (mm) | 1450 | 1450 | 1450 | 1450 | 1450 |
| Strip width (mm) | 1577 | 1577 | 1577 | 1577 | 1577 |
| Inlet-side strip thickness (mm) | 31.0 | 21.0 | 14.4 | 10.0 | 7.0 |
| Outlet-side strip thickness (mm) | 21.0 | 14.4 | 10.0 | 7.0 | 4.88 |
| The amount of reduction in thickness (mm) | 10.0 | 6.6 | 4.4 | 3.0 | 2.12 |
| Reduction in thickness (%) | 33 | 31 | 31 | 30 | 30 |
| Rolling force (kN) | 24343 | 19669 | 17130 | 17130 | 20384 |
| Rolling force per unit width (kN/mm) | 15.4 | 12.5 | 10.9 | 10.9 | 12.9 |
| Work roll bending force (kN/chock) | 823 | 823 | 823 | 823 | 1176 |
| Cross angle (deg) | 0.31 | 0.33 | 0.30 | 0.31 | 0.0 |

Figure 17:
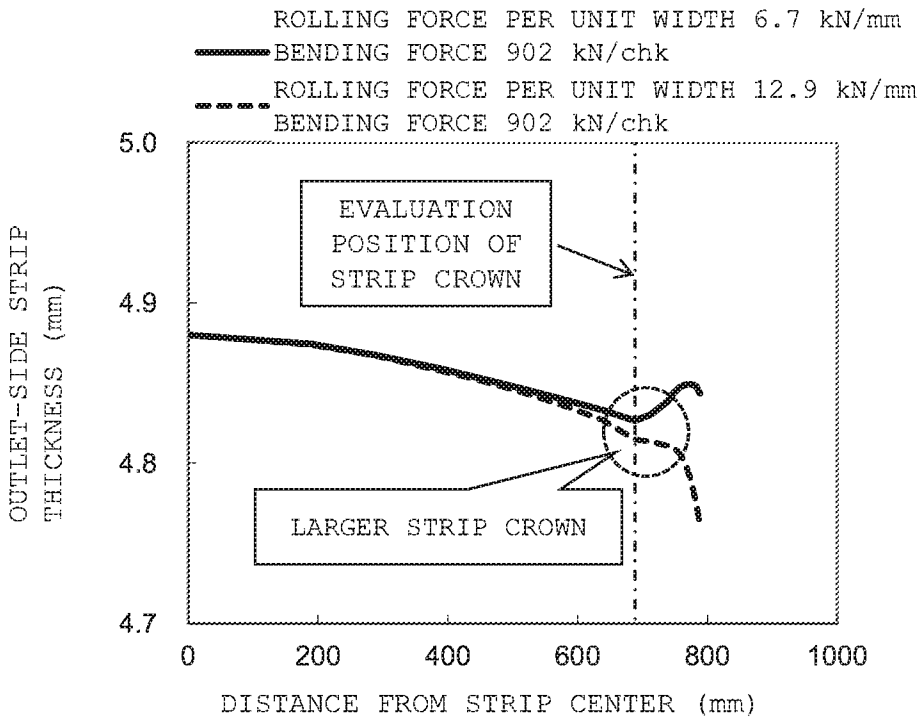
FIG. 17 is a diagram showing one example of change in the strip profile before changing the bending force on the last stand outlet side based on the strip profile control in embodiment 1.
Figure 18:
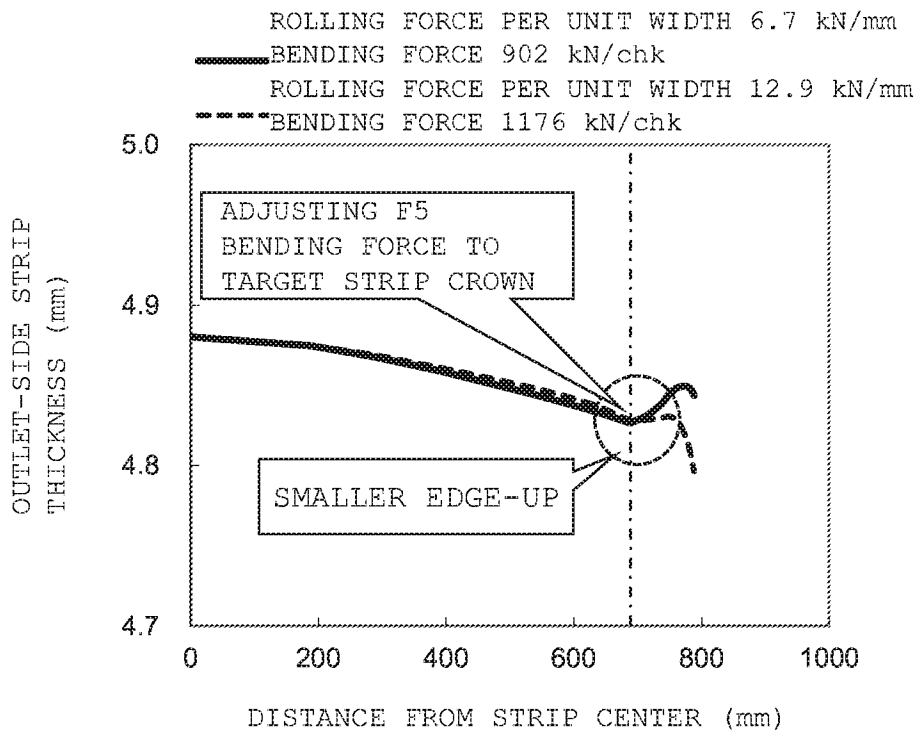
FIG. 18 is a diagram showing one example of change in the strip profile after changing the bending force on the last stand outlet side based on the strip profile control in embodiment 1.

In FIG. 17, the calculation result of the strip profile on the outlet side of the last stand 100 when the rolling force per unit width in tandem rolling calculation condition 3 is raised from 6.7 kN/mm to 12.9 kN/mm (corresponding to (1) in FIGS. 14, 15, and 16) is shown. In FIG. 18, the calculation result of the strip profile on the outlet side of the last stand 100 when the work roll benders 140 at the last stand 100 in tandem rolling calculation condition 3 are adjusted toward the increase side (corresponding to (2) in FIGS. 14, 15, and 16) is shown.

As shown in FIG. 17. it turned out that the strip crown became larger in the profile on the outlet side of the last stand 100 by raising the rolling force per unit width. Furthermore, as shown in FIG. 18, it turned out that the strip crown at the position of 100 mm from the strip end could be controlled to the same value by adjusting the work roll benders 140 toward the increase side. It also turned out that the amount of edge-up was also a small result at this time.

Next, description will be made below about one example of the method for deciding the predetermined pass schedule in the decision control device 60 in the case in which the strip crown cannot be set to the predetermined value while the strip shape is kept within the allowable range only by the work roll benders 140 at the last stand 100.

Depending on the rolling condition, it is often difficult to cause the edge profile to fall within the allowable range and cause the strip shape on the outlet side of the last stand 100 to fall within the allowable range and set the strip crown to the predetermined value or smaller only by adjusting the rolling force per unit width at the last stand 100 and the work roll bending force of the work roll benders 140 of the last stand 100. In such a case, the decision control device 60 adjusts also the work roll benders 14, 24, 34, and 44 from the latter stage side sequentially to change the inlet-side strip profile and create the predetermined pass schedule.

As described above, it is possible to control the strip crown to the predetermined value in the related-art method. However, regarding the strip crown, it is impossible to keep a strip crown ratio (defined based on the ratio ($C_H$/H) of the thickness (H) of the center of the rolling material before rolling and the crown ($C_H$)) constant in rolling in the direction of center waves. In contrast, in the present embodiment, also regarding the strip shape and the strip crown deviated due to the adjustment of the rolling force per unit width at the last stand 100, the target strip crown can be satisfied by adjusting the work roll benders 140.

Furthermore, if the rolling force per unit width at the last stand 100 is adjusted in order to satisfy the condition under which the strip crown ratio is constant, the need to modify also the reduction schedule arises.

Figure 19:
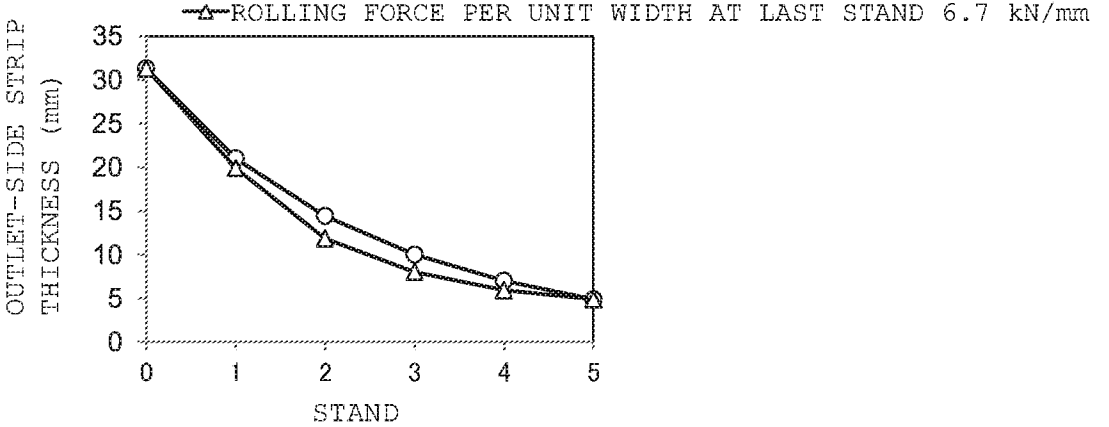
FIG. 19 is a diagram showing one example of reduction schedules at the respective stands according to the rolling force per unit width at the last stand in embodiment 1.
Figure 20:
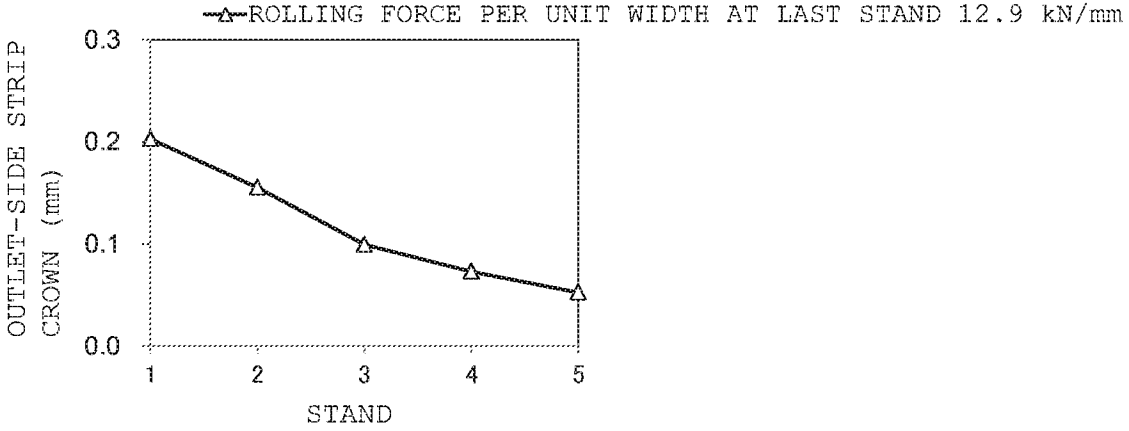
FIG. 20 is a diagram showing the target value of the strip crown on the outlet side of each stand when the rolling force per unit width at the last stand is 12.9 kN/mm in embodiment 1.

Specifically, as shown in FIG. 19, the inlet-side strip thickness and the target strip thickness on the last outlet side in the rolling mill are fixed and the amount of reduction in thickness with which the necessary rolling force per unit width at the last stand 100 is obtained is decided by using deformation resistance set in advance. Furthermore, the work roll benders 140 are adjusted to cause the strip shape to fall within the allowable range and obtain the predetermined strip crown as shown in FIG. 20.

Figure 21:
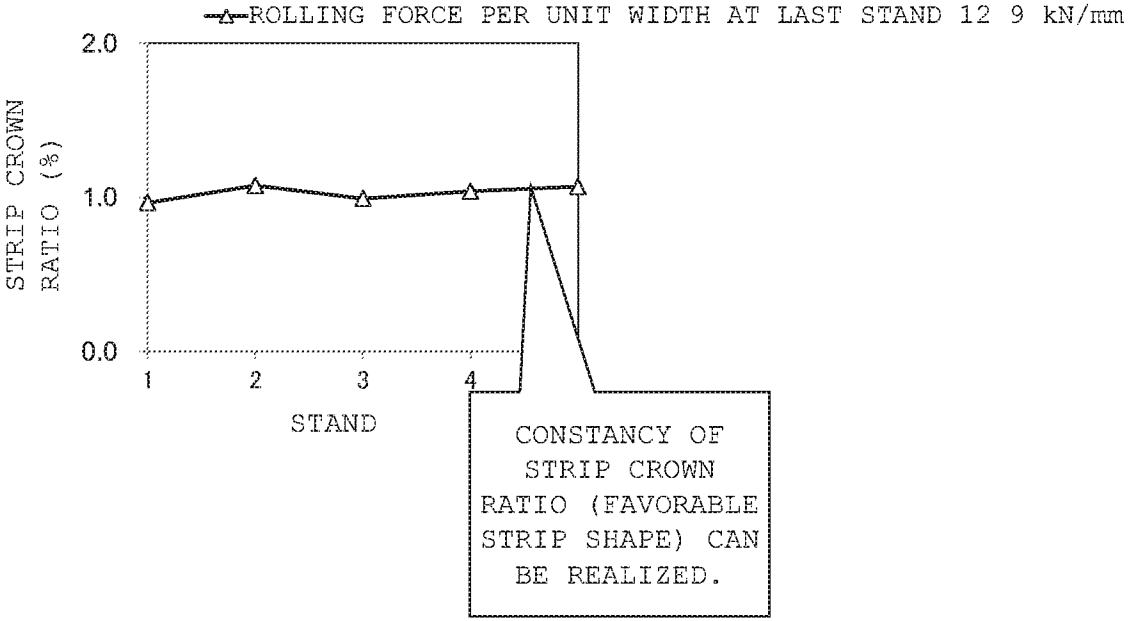
FIG. 21 is a diagram showing a strip crown ratio schedule when the rolling force per unit width at the last stand is 12.9 kN/mm in embodiment 1.

It is ideal that, by this work, the constancy of the strip crown ratio can be realized on the outlet side of all stands as shown in FIG. 21. However, if it is impossible to realize the constancy of the strip crown ratio, the amount of reduction in thickness at the upstream-side stand is modified and the work roll benders 140 are adjusted to realize the constancy of the strip crown ratio on the upstream side. Moreover, until the reduction schedule that satisfies the constancy of the strip crown ratio at all stands is obtained by this work, the reduction schedule by the reduction devices 15, 25, 35, and 45 and the work roll bending force by the work roll benders 14, 24, 34, and 44 are modified from the latter stage side sequentially toward the upstream-side stand.

Figure 22:
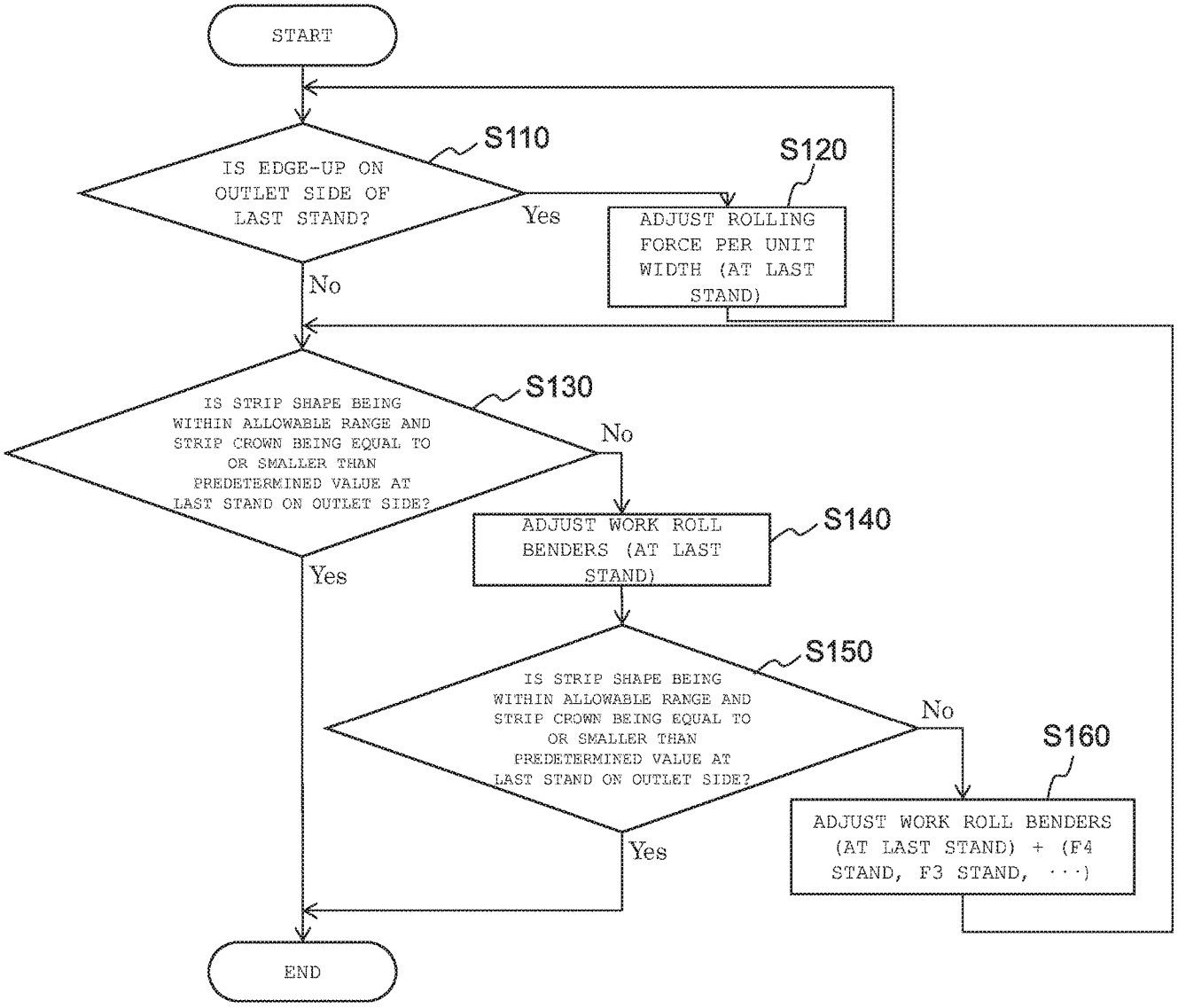
FIG. 22 is a diagram showing a control flow of the strip profile in embodiment 1.

In FIG. 22, a control flow for the decision of the predetermined pass schedule in the decision control device 60 is shown.

First, the decision control device 60 determines whether or not the edge profile on the outlet side of the last stand 100 based on the existing pass schedule is an edge-up (step S110). The decision control device 60 forwards the processing to a step S120 when it is determined that the edge profile is an edge-up, and forwards the processing to a step S130 when it is determined that the edge profile is not an edge-up.

When it is determined that the edge profile is an edge-up in the step S110, the decision control device 60 adjusts the rolling force per unit width at the last stand 100 from the relationship between the strip crown and the edge-up obtained in advance, stored in the storing unit 80. Then, the decision control device 60 returns the processing to S110 and determines whether or not the edge profile is an edge-up again to obtain the condition under which the edge-up does not appear.

When it is determined that the edge profile is not an edge-up in the step S110, the decision control device 60 determines whether or not the strip shape is within an allowable range and the strip crown at the last stand 100 is a predetermined value or smaller when the rolling force per unit width selected in the step S110 is set (step S130). When it is determined that the strip shape is within the allowable range and the strip crown at the last stand 100 is the predetermined value or smaller, the decision control device 60 sets a pass schedule with which special strip profile control by the work roll benders 140 is not carried out, and ends the processing. When it is determined that the strip shape is not within the allowable range or the strip crown is not the predetermined value or smaller, the decision control device 60 forwards the processing to a step S140.

Subsequently, the decision control device 60 adjusts the work roll bending force of the work roll benders 140 at the last stand 100 based on the relationship between the strip crown and the edge profile stored in the storing unit 80 in advance like that shown in FIG. 13 (step S140).

Subsequently, the decision control device 60 determines whether or not the strip shape on the outlet side of the last stand 100 is within the allowable range and the strip crown at the last stand 100 is the predetermined value or smaller again (step S150). The decision control device 60 ends the processing when it is determined that the strip shape is within the allowable range and the strip crown at the last stand 100 is the predetermined value or smaller. The decision control device 60 forwards the processing to a step S160 when it is determined that the strip shape is not within the allowable range or the strip crown is not the predetermined value or smaller.

When it is determined that the strip shape is within the allowable range and the strip crown at the last stand 100 is not the predetermined value or smaller in the step S150, the decision control device 60 adjusts the work roll bending force by the work roll benders 44, 34, 24, or 14 from the finish latter stage side sequentially (F4 stand 40 in the first round of step S160, F3 stand 30 in the second round of step S160, F2 stand 20 in the third round, . . . ) (step S160). That is, if the strip shape on the outlet side of the last stand 100 does not fall within the allowable range or the strip crown on the outlet side of the last stand does not become the predetermined value also at a stand before the last stand, the decision control device 60 adjusts the bending force (strip shape control parameter) of the work roll benders toward the further upstream side sequentially. Thereafter, the decision control device 60 returns the processing to the step S130 and carries out determination. Thereby, the decision control device 60 seeks a solution with which the strip shape falls within the allowable range and the strip crown becomes the predetermined value and decides the final pass schedule to carry out strip profile control.

Next, effects of the present embodiment will be described.

In the hot finishing tandem rolling mill 1 of the above-described embodiment 1 of the present invention, in the decision control device 60 of the control system 50, a predetermined pass schedule is decided by adjusting the rolling force per unit width at the last stand 100 to cause the edge profile on the outlet side of the last stand 100 to fall within an allowable range based on the relationship between the strip crown and the edge profile on the outlet side of the last stand 100 with respect to the rolling force per unit width and the strip shape control parameter, obtained regarding the last stand 100 of the hot finishing tandem rolling mill 1, and adjusting the strip shape control parameter of the last stand 100 to cause the strip shape on the outlet side of the last stand 100 to fall within an allowable range and cause the strip crown to become a predetermined value or smaller. Moreover, in the rolling mill control device 70, the reduction devices 15, 25, 35, 45, and 150 are controlled to obtain the adjusted rolling force per unit width at the last stand 100 and the work roll benders 14, 24, 34, 44, and 140 are controlled to obtain the adjusted strip shape control parameter of the last stand 100.

Due to this, in hot finishing tandem rolling, not only can the edge profile be controlled to the predetermined value or smaller, but the strip crown can also be controlled to the predetermined value or smaller while the strip shape is kept within the allowable range. Thus, a favorable strip profile can be obtained.

Furthermore, in deciding the predetermined pass schedule, if the strip shape on the outlet side of the last stand 100 does not fall within the allowable range or the strip crown does not become the predetermined value or smaller only by the adjustment of the strip shape control parameter of the last stand 100, the decision control device 60 adjusts the strip shape control parameter of the upstream-side stands (F1 stand 10 to F4 stand 40) to cause the strip shape at the last stand 100 to fall within the allowable range and cause the strip crown to become the predetermined value or smaller from the last stand 100 toward the upstream side sequentially. Therefore, not only can the edge profile be controlled to the predetermined value or smaller more surely, but the strip crown can also be controlled to the predetermined value or smaller while the strip shape is kept within the allowable range.

Moreover, regarding the existing pass schedule of the hot finishing tandem rolling mill 1, the adjustment of the rolling force per unit width at the last stand 100 is carried out based on the relationship between the strip crown and the edge profile on the outlet side of the last stand 100. Then, the adjustment of the strip shape control parameter of the last stand 100 is carried out regarding the intermediate pass schedule obtained by adjusting the rolling force per unit width of the existing pass schedule. Thereby, not only can the edge profile be controlled to the predetermined value or smaller stably and surely, but the strip crown can also be controlled to the predetermined value or smaller while the strip shape is kept within the allowable range.

Furthermore, in deciding the predetermined pass schedule, the amount of reduction in thickness at the last stand 100 for realizing the rolling force per unit width at the last stand 100 is obtained and a reduction schedule is decided to cause the strip shape to fall within the allowable range based on this amount of reduction in thickness. Thereby, the constancy of the strip crown ratio on the outlet side of the respective stands can be realized. Thus, the strip shape also becomes favorable and it becomes possible to provide a more favorable strip profile.

In addition, the strip shape control parameter of the last stand 100 is the work roll bending force of the work roll benders 140. Thus, the work roll benders 140, which are easy to adjust in rolling, are changed, which can obtain a favorable strip profile more easily.

Embodiment 2

A strip profile control method of a hot finishing tandem rolling mill and a hot finishing tandem rolling mill according to embodiment 2 of the present invention will be described by using FIG. 23 to FIG. 25. The same configuration as embodiment 1 is given the same numeral and description thereof is omitted.

Figure 23:
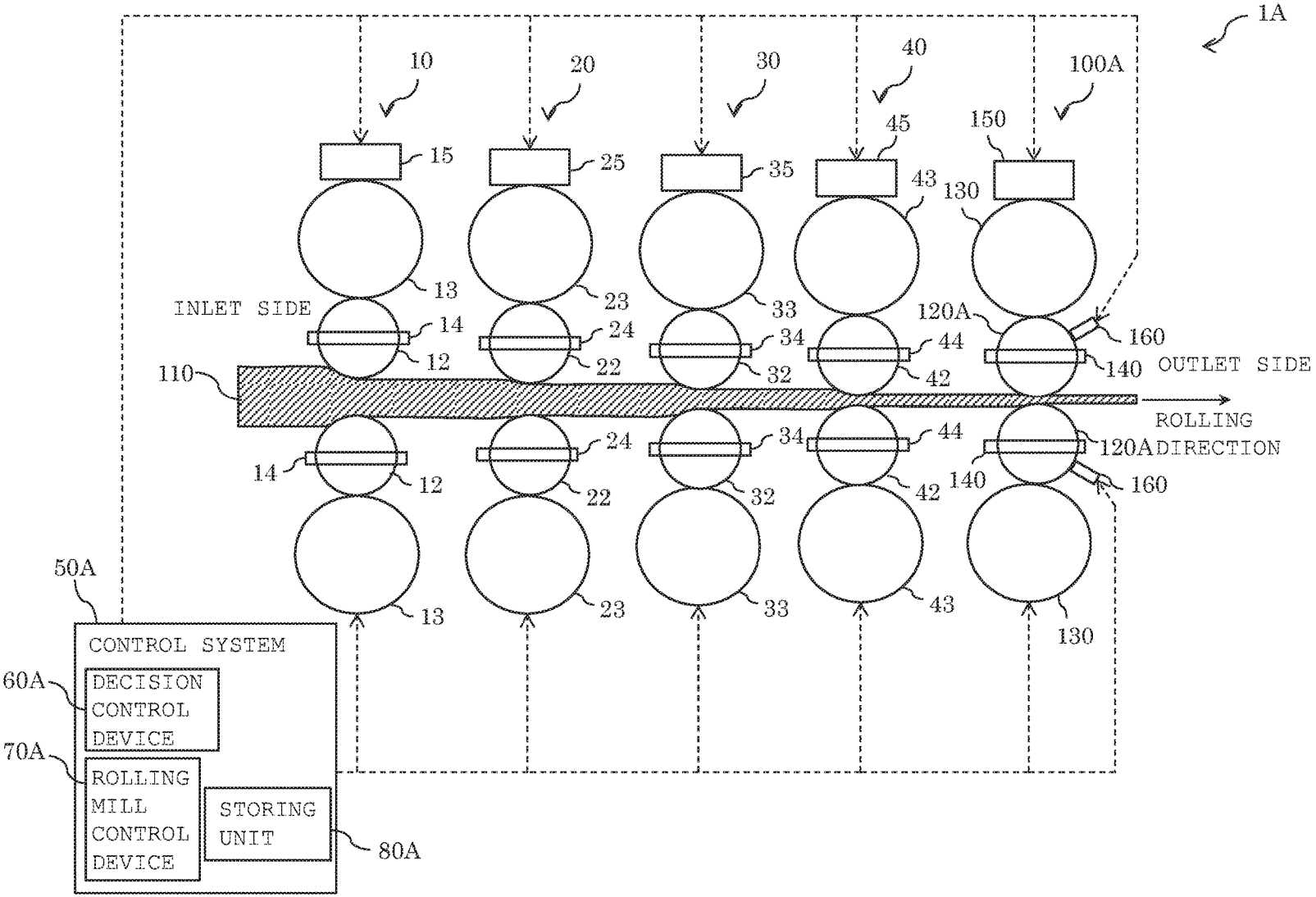
FIG. 23 is a diagram showing the outline of a hot finishing tandem rolling mill of embodiment 2 of the present invention.
Figure 24:
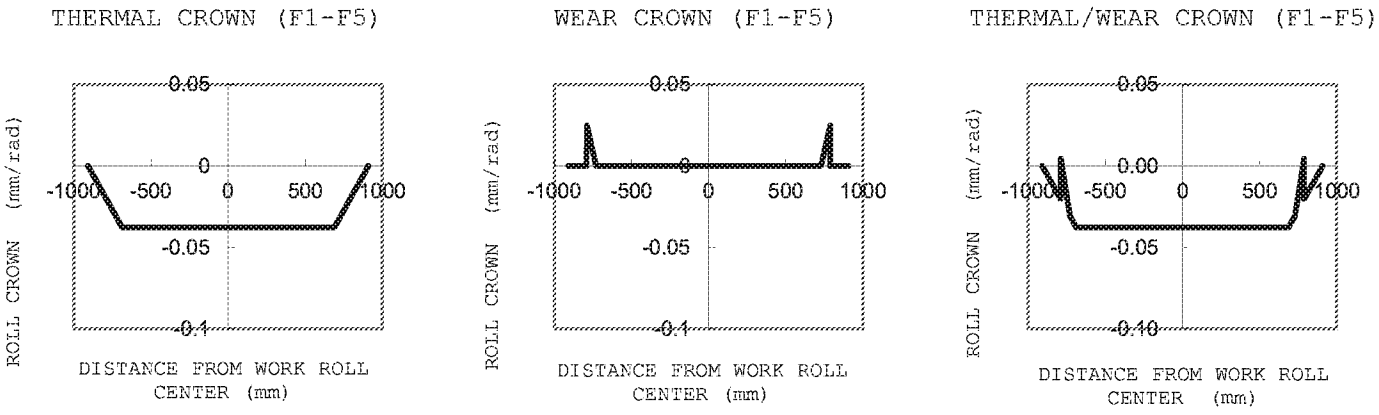
FIG. 24 is a diagram showing the setting of a thermal crown and a wear crown of work rolls of the respective stands in Table 5.

As shown in FIG. 23, in a hot finishing tandem rolling mill 1A of the present embodiment, roll polishing devices 160 are further disposed around work rolls 120A of an F5 stand 100A in addition to the hot finishing tandem rolling mill 1 of embodiment 1.

The roll polishing devices 160 are devices that polish the surface of the worn work roll 120A in an online or offline manner.

Furthermore, in a decision control device 60A of a control system 50A, a predetermined pass schedule is decided by adjusting the rolling force per unit width at the last stand 100A to cause the edge profile to fall within the allowable range also in consideration of that the work rolls 120A have been polished by the roll polishing devices 160 disposed at the last stand 100A.

The rolling mill control device 70A controls the reduction devices 15, 25, 35, 45, and 150, the work roll benders 14, 24, 34, 44, and 140, and the roll polishing devices 160 to carry out rolling at each of the F1 stand 10 to the F5 stand 100A based on the predetermined pass schedule decided in the decision control device 60A and polish the work rolls 120A of the last stand 100A by the roll polishing devices 160.

Next, one example of the calculation result of the rolled steel strip profile in the hot finishing tandem rolling mill 1A will be described.

Figure 25:
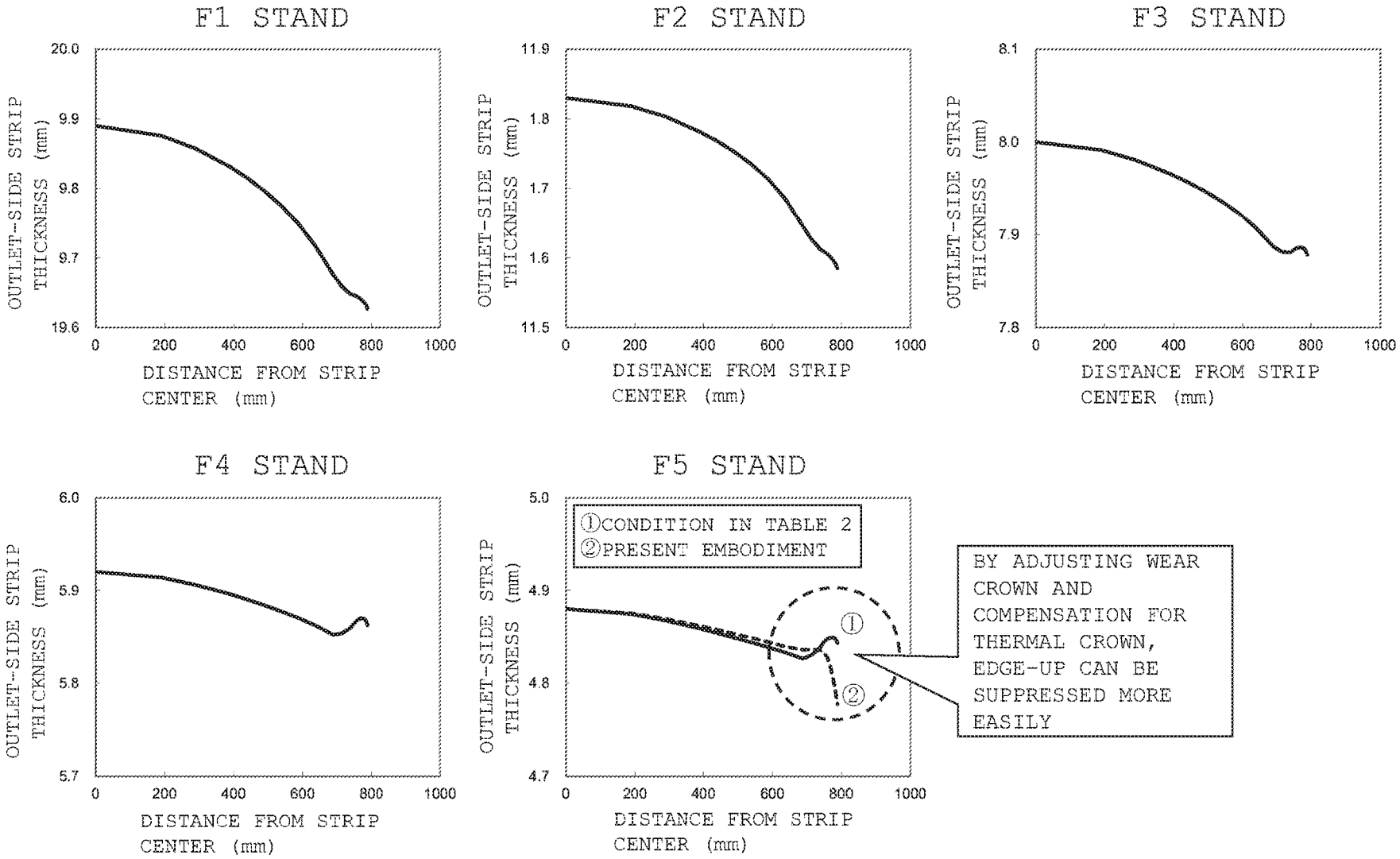
FIG. 25 is a diagram showing one example of the strip profile on the outlet side of the respective stands under a condition in which the thermal and wear crowns at the last stand are absent, shown in Table 5, in embodiment 2.

The calculation condition of the present embodiment in which a compensation for the thermal crown is made by placing the roll polishing devices 160 at the last stand 100A and adjusting the wear crown is shown in Table 5, and the result is shown in FIG. 25.

In Table 5, the rolling force per unit width at the last stand 100A is set to 6.7 kN/mm. Regarding the thermal crown, the wear crown, and the initial crown of the work rolls 12, 22, 32, and 42 of the F1 stand 10 to the F4 stand 40, the following profiles were considered as shown in FIG. 24: −37.5 μm/rad for the thermal crown (position of 100 mm from the strip end), −25 μm/rad for the wear crown (position of 60 mm from the strip end), and −140 μm/rad for the initial crown.

Furthermore, because the surfaces of the work rolls 120A of the F5 stand 100A are constantly improved by the roll polishing devices 160, the thermal crown, the wear crown, and the roll crown were set to 0. The condition of this Table 5 is defined as tandem rolling calculation condition 4.

TABLE 5

| | F1 stand | F2 stand | F3 stand | F4 stand | F5 stand |
|---|---|---|---|---|---|
| Work roll diameter (mm) | 825 | 825 | 680 | 680 | 680 |
| Back-up roll diameter (mm) | 1450 | 1450 | 1450 | 1450 | 1450 |
| Strip width (mm) | 1577 | 1577 | 1577 | 1577 | 1577 |
| Inlet-side strip thickness (mm) | 31.00 | 19.89 | 11.83 | 8.0 | 5.92 |
| Outlet-side strip thickness (mm) | 19.89 | 11.83 | 8.0 | 5.92 | 4.88 |
| The amount of reduction in thickness (mm) | 11.11 | 8.06 | 3.83 | 2.08 | 1.04 |
| Reduction in thickness (%) | 36 | 41 | 32 | 26 | 18 |
| Rolling force (kN) | 27430 | 26293 | 17728 | 14161 | 10618 |
| Rolling force per unit width (kN/mm) | 17.4 | 16.7 | 11.2 | 9.0 | 6.7 |
| Work roll bending force (kN/chock) | 823 | 823 | 823 | 823 | 902 |
| Cross angle (deg) | 0.31 | 0.33 | 0.30 | 0.31 | 0.0 |

As shown in FIG. 25, it turned out that, by placing the roll polishing devices 160 at the last stand 100A to make a compensation for the thermal crown, the edge-up could be suppressed even when the conditions of the work roll diameter, the back-up roll diameter, the strip width, the inlet-side strip thickness, the outlet-side strip thickness, the amount of reduction in thickness, the reduction in thickness, the rolling force, the rolling force per unit width, the work roll bending force, and the cross angle were the same as tandem rolling calculation condition 1, and it turned out that the adjustment of the rolling force per unit width could be greatly reduced.

The other configuration and operation are substantially the same configuration and operation as the strip profile control method of a hot finishing tandem rolling mill and the hot finishing tandem rolling mill 1 according to the above-described embodiment 1, and description of details thereof is omitted.

Also in the strip profile control method of a hot finishing tandem rolling mill and the hot finishing tandem rolling mill according to embodiment 2 of the present invention, substantially the same effects as the strip profile control method of a hot finishing tandem rolling mill and the hot finishing tandem rolling mill according to the above-described embodiment 1 are achieved.

Furthermore, by disposing the roll polishing devices in the hot finishing tandem rolling mill 1A and polishing the work rolls 120A of the last stand 100A by using the roll polishing devices 160 while carrying out rolling at the respective stands (F1 stand 10 to F5 stand 100A) by using a pass schedule to thereby carry out the rolling while adjusting the wear crown of the surfaces of the work rolls 120A, the rolling is carried out while the surface shape of the work rolls 120A is improved. Thus, the edge profile on the last stand outlet side can be controlled to the predetermined value more easily. Therefore, an effect that the control range of the respective parameters such as the rolling force per unit width at the last stand 100A is widened and the operation becomes easier is achieved. Furthermore, because the surfaces of the work rolls 120A are adjusted, an effect that a lot of equipment investment necessary for remodeling of the work rolls 120A can be reduced is also achieved. By using the roll polishing devices 160 only at the last stand 100A without using roll polishing devices at the stands previous to the last stand 100A, a favorable strip profile can be kept while the initial equipment cost and the maintenance cost are suppressed, which is particularly beneficial.

Others

The present invention is not limited to the above-described embodiments and various modification examples are included therein. The above-described embodiments are configurations described in detail in order to explain the present invention in an easy-to-understand manner and are not necessarily limited to what includes all described configurations.

What is claimed is:

1. A strip profile control method of a hot finishing tandem rolling mill having a plurality of stands, the strip profile control method comprising:

adjusting a rolling force per unit width at a last stand of the hot finishing tandem rolling mill to cause an edge-up or edge drop on an outlet side of the last stand to fall within a predetermined range based on a relationship between a strip crown and the edge-up or edge drop on the outlet side of the last stand with respect to the rolling force per unit width and a flatness control parameter obtained regarding the last stand;

adjusting the flatness control parameter of the last stand to cause flatness on the outlet side of the last stand to fall within a predetermined range and cause the strip crown to become a predetermined value or smaller; and adjusting a pass schedule of the last stand based on the adjusted rolling force per unit width and the adjusted flatness control parameter of the last stand, wherein the flatness control parameter includes at least one of a work roll bending force of a work roll bender of the last stand, a roll cross angle of the last stand, or an amount of roll shift of the last stand.

2. The strip profile control method of a hot finishing tandem rolling mill according to claim 1, further comprising:

adjusting the flatness control parameter of upstream-side stands to cause the flatness at the last stand to fall within the predetermined range and cause the strip crown to become the predetermined value or smaller from the last stand toward the upstream side sequentially if the flatness on the outlet side of the last stand does not fall within the predetermined range or the strip crown on the outlet side of the last stand does not become the predetermined value or smaller only by the adjusting the flatness control parameter of the last stand.

3. The strip profile control method of a hot finishing tandem rolling mill according to claim 1, further comprising:

obtaining the amount of reduction in thickness at the last stand for realizing the rolling force per unit width at the last stand and deciding a reduction schedule to cause the flatness to fall within the predetermined range based on the amount of reduction in thickness.

4. The strip profile control method of a hot finishing tandem rolling mill according to claim 1, further comprising:

polishing a work roll of the last stand while carrying out rolling at each stand by using the pass schedule.

5. The strip profile control method of a hot finishing tandem rolling mill according to claim 1, wherein the adjusting the rolling force per unit width at the last stand is carried out based on the relationship between the strip crown and the edge-up or edge drop on the outlet side of the last stand regarding an existing pass schedule of the hot finishing tandem rolling mill, and the adjusting the flatness control parameter of the last stand is carried out regarding an intermediate pass schedule obtained by the adjusting the rolling force per unit width of the existing pass schedule.

6. A hot finishing tandem rolling mill, comprising:

a plurality of stands;

a plurality of reduction devices and a plurality of strip shape control actuators that are respectively provided at each one of the plurality of stands;

a decision control device configured to decide a predetermined pass schedule; and a rolling mill control device configured to control the reduction devices and the strip shape control actuators based on the predetermined pass schedule decided in the decision control device, wherein:

the decision control device is configured to decide the predetermined pass schedule by adjusting rolling force per unit width at a last stand of the hot finishing tandem rolling mill to cause an edge-up or edge drop on an outlet side of the last stand to fall within a predetermined range based on a relationship between a strip crown and the edge-up or edge drop on the outlet side of the last stand with respect to the rolling force per unit width and a flatness control parameter, obtained regarding the last stand, and configured to adjust the flatness control parameter of the last stand to cause flatness on the outlet side of the last stand to fall within a predetermined range and cause the strip crown to become a predetermined value or smaller, and the rolling mill control device is configured to control the reduction devices to obtain the adjusted rolling force per unit width at the last stand and control the strip shape control actuators to obtain the adjusted flatness control parameter of the last stand, wherein the flatness control parameter includes at least one of a work roll bending force of a work roll bender of the last stand, a roll cross angle of the last stand, or an amount of roll shift of the last stand.

7. The hot finishing tandem rolling mill according to claim 6, wherein when deciding the predetermined pass schedule, the decision control device adjusts the flatness control parameter of upstream-side stands to cause the flatness at the last stand to fall within the predetermined range and cause the strip crown to become the predetermined value or smaller from the last stand toward the upstream side sequentially if the flatness on the outlet side of the last stand does not fall within the predetermined range or the strip crown on the outlet side of the last stand does not become the predetermined value or smaller only by adjustment of the flatness control parameter of the last stand.

8. The hot finishing tandem rolling mill according to claim 6, wherein when deciding the predetermined pass schedule, the decision control device obtains the amount of reduction in thickness at the last stand for realizing the rolling force per unit width at the last stand and decides a reduction schedule to cause the flatness to fall within the predetermined range based on the amount of reduction in thickness.

9. The hot finishing tandem rolling mill according to claim 6, further comprising:

a roll polishing device, wherein the rolling mill control device controls the reduction devices, the strip shape control actuators, and the roll polishing device to carry out rolling at each of the plurality of stands based on the predetermined pass schedule and polish a work roll of the last stand by the roll polishing device.

* * * * *